US010324399B2

(12) United States Patent
Yagi et al.

(10) Patent No.: US 10,324,399 B2
(45) Date of Patent: Jun. 18, 2019

(54) IMAGE FORMING APPARATUS AND IMAGE FORMING METHOD

(71) Applicant: CANON KABUSHIKI KAISHA, Tokyo (JP)

(72) Inventors: Yasutaka Yagi, Mishima (JP); Sara Yoshida, Mishima (JP); Shinsuke Mochizuki, Yokohama (JP); Tsuneyoshi Tominaga, Suntou-gun (JP); Kenta Kamikura, Yokohama (JP); Tsutomu Shimano, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/109,594

(22) Filed: Aug. 22, 2018

(65) Prior Publication Data

US 2019/0064705 A1 Feb. 28, 2019

(30) Foreign Application Priority Data

Aug. 30, 2017 (JP) ..... 2017-166006

(51) Int. Cl.
*G03G 15/08* (2006.01)
*G03G 15/16* (2006.01)

(52) U.S. Cl.
CPC ..... *G03G 15/162* (2013.01)

(58) Field of Classification Search
CPC .. G03G 15/08; G03G 15/0848; G03G 15/162; G03G 9/093; G03G 9/09307; G03G 9/09314; G03G 9/0821
USPC ..... 399/252, 302
See application file for complete search history.

(56) References Cited

U.S. PATENT DOCUMENTS 9,766,566 B2 * 9/2017 Mochizuki et al. ..... G03G 9/09321
2018/0329320 A1 * 11/2018 Yoshida et al. .... G03G 9/09307

FOREIGN PATENT DOCUMENTS

JP 2009-186640 A 8/2009
JP 5407377 B2 2/2014

* cited by examiner

*Primary Examiner* — William J Royer
(74) *Attorney, Agent, or Firm* — Canon U.S.A.Inc., IP Division

(57) ABSTRACT

An image forming apparatus includes an image bearing member, a developing device, and an intermediate transfer member. The developing device includes a toner container containing a toner. The intermediate transfer member is charged to 3.0 nC/g or less in terms of absolute value at the surface thereof. The toner particles include a surface layer, and the brightness histogram of the toner particles has two local maximums P1 and P2 and a local minimum V between P1 and P2. P2 is derived from an organosilicon polymer. P1 lies in a brightness range of 20 to 70, and P2 lies in a brightness range of 130 to 230. The number of pixels of P1 and the number of pixels of P2 are each 0.50% or more relative to the total number of pixels. The total numbers of pixels A1, AV, and A2 each in a specific brightness range satisfy specific relationships.

8 Claims, 4 Drawing Sheets

IMAGE FORMING APPARATUS AND IMAGE FORMING METHOD

BACKGROUND OF THE INVENTION

Field of the Invention

The present disclosure relates to an image forming apparatus using an electrophotographic system or an electrostatic recording system, such as a copy machine, a printer, or a facsimile machine, and to an image forming method using such a system.

Description of the Related Art

Further reduced power consumption and further improved image quality are desired for image forming apparatuses. To respond to this, various studies have been conducted for developing toners having high fixability and high transferability.

For example, there has been devised a toner that is not likely to cause thin paper to stick to the heating member of the fuser while keeping good fixability at low temperature. Japanese Patent Laid-Open No. 2009-186640 discloses a toner including core particles coated with a resin shell layer in which a specific hole is formed for preventing sticking.

However, the toner provided with only the shell layer have disadvantages with development and transfer in view of flowability and chargeability, and an external additive must be added. Unfortunately, the external additive may sink in the mass of the toner particles or may be removed when the toner is repeatedly used. Further improvement is desired in terms of the durability of the toner.

Japanese Patent No. 5407377 discloses a toner provided with both a coating layer of a silane compound and externally added inorganic particles from the viewpoint of increasing the stability of charge of the toner to improve the durability.

Unfortunately, in the technique disclosed in Japanese Patent 5407377, the coating layer covers the toner base particles at a high level. This hinders the toner from being fixed, and the toner is still likely to cause thin paper to stick to the fuser particularly at low temperature.

SUMMARY OF THE INVENTION

Accordingly, the present disclosure provides an image forming apparatus and an image forming method that do not easily allow thin paper to stick to the fuser even during fixing at low temperature and do not easily cause insufficient transfer (nonuniform transfer) even when repeatedly used in a high-temperature, high-humidity environment.

According to an aspect of the present disclosure, there is provided an image forming apparatus including an image bearing member, a developing device configured to form a toner image on the image bearing member with a toner on a toner bearing member, and an intermediate transfer member to which the toner image is primarily transferred from the image bearing member and from which the toner image is secondarily transferred to a transfer medium. The developing device includes the toner bearing member and a toner container containing the toner. The intermediate transfer member has a charge of 3.0 nC/g or less in terms of absolute value at the surface thereof when charged by a slanted charging method. The toner includes toner particles containing a binder resin and a releasing agent, and toner particles include a surface layer containing an organosilicon polymer.

When a brightness (luminance) histogram of the number of pixels (the pixel value) with reference to 256 levels of brightness on the horizontal axis thereof is obtained from a backscattered electron image of a square area 1.5 μm on a side of the surface of the toner particles taken by observing the surface of the toner particles by scanning electron microscopy, the histogram has two local maximums P1 and P2 and a local minimum V between P1 and P2. Local maximum P2 is derived from the organosilicon polymer. Local maximum P1 lies in the brightness range of 20 to 70, and local maximum P2 lies in the brightness range of 130 to 230. The number of pixels of P1 and the number of pixels of P2 are each 0.50% or more relative to the total number of pixels of the backscattered electron image. With reference to a brightness V1 of the local minimum V, a total number A1 of pixels with a brightness of 0 to (V1−30), a total number AV of pixels with a brightness of (V1−29) to (V1+29), and a total number A2 of pixels with a brightness of (V1+30) to 255 satisfy the following relationships (1) and (2):

$$(A1/AV) \geq 1.50 \quad (1)$$

$$(A2/AV) \geq 1.50 \quad (2).$$

According to another aspect of the present disclosure, there is provided an image forming method including: forming a toner image on an image bearing member by development with a toner on a toner bearing member; primarily transferring the toner image to an intermediate transfer member; and secondarily transferring the toner image on the intermediate transfer member to a transfer medium. The intermediate transfer member has a charge of 3.0 nC/g or less in terms of absolute value at the surface thereof when charged by a slanted charging method. The toner includes toner particles containing a binder resin and a releasing agent, and the toner particles include a surface layer containing an organosilicon polymer.

When a brightness histogram of the number of pixels with reference to 256 levels of brightness on the horizontal axis thereof is obtained from a backscattered electron image of a square area 1.5 μm on a side of the surface of the toner particles taken by observing the surface of the toner particles by scanning electron microscopy, the histogram has two local maximums P1 and P2 and a local minimum V between P1 and P2. Local maximum P2 is derived from the organosilicon polymer. Local maximum P1 lies in the brightness range of 20 to 70, and local maximum P2 lies in the brightness range of 130 to 230. The number of pixels of P1 and the number of pixels of P2 are each 0.50% or more relative to the total number of pixels of the backscattered electron image. With reference to a brightness V1 of the local minimum V, a total number A1 of pixels with a brightness of 0 to (V1−30), a total number AV of pixels with a brightness of (V1−29) to (V1+29), and a total number A2 of pixels with a brightness of (V1+30) to 255 satisfy the following relationships (1) and (2):

$$(A1/AV) \geq 1.50 \quad (1)$$

$$(A2/AV) \geq 1.50 \quad (2).$$

Further features will become apparent from the following description of exemplary embodiments with reference to the attached drawings.

DESCRIPTION OF THE EMBODIMENTS

In the description disclosed herein, numerical ranges expressed as " . . . of to ××" or "fromto ××" each include the lower and the upper limit being the values at the ends of the range, unless otherwise specified.

The image forming apparatus according to the embodiments of the present disclosure includes an image bearing member, a developing device configured to form a toner image on the image bearing member with a toner on a toner bearing member, and an intermediate transfer member to which the toner image is primarily transferred from the image bearing member and from which the toner image is secondary transferred to a transfer medium. The developing device includes the toner bearing member and a toner container containing the toner.

The image forming method according to the embodiments of the present disclosure includes forming a toner image on an image bearing member by development with a toner on a toner bearing member, primarily transferring the toner image to an intermediate transfer member, and secondarily transferring the toner image from the intermediate transfer member to a transfer medium.

Image Forming Apparatus

Figure 3:
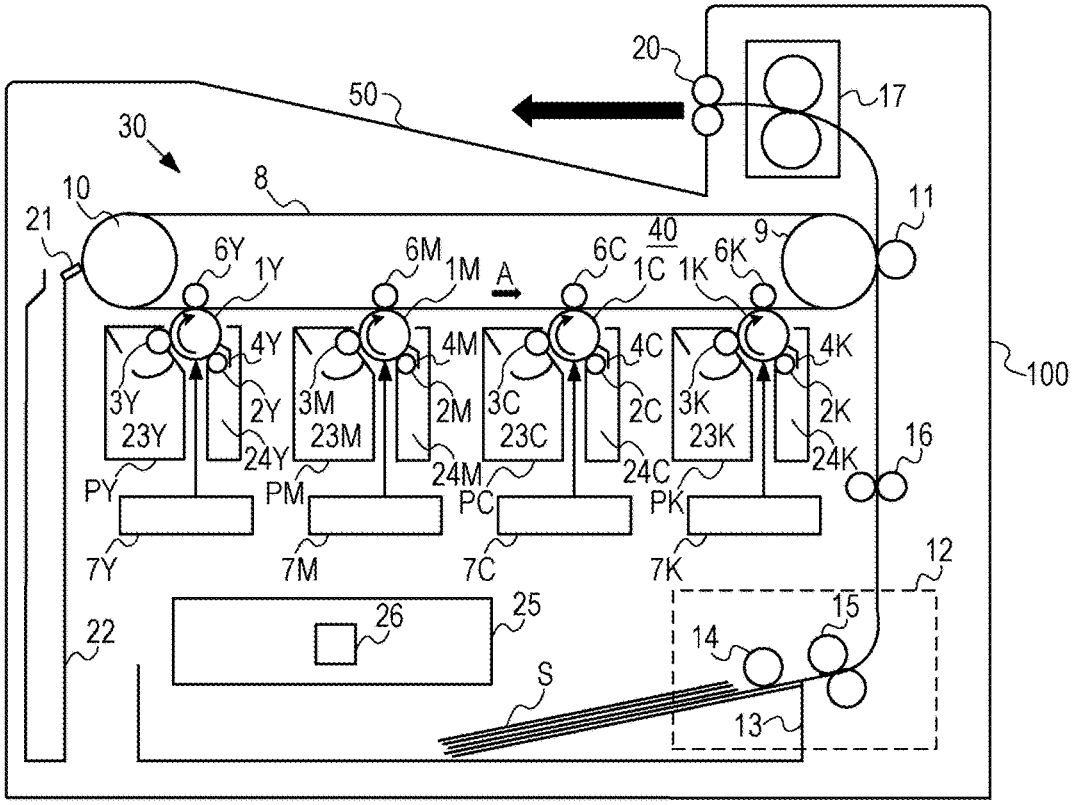
FIG. 3 is a schematic sectional view of an image forming apparatus.

FIG. 3 is a schematic sectional view of an exemplary image forming apparatus that transfers the toner image formed on a rotatable image bearing member to a transfer medium. In the following embodiment of the image forming apparatus, by way of example, an intermediate transfer belt is used as the intermediate transfer member, and a developing roller is used as the toner bearing member.

An image forming unit 30 is intended to form a superimposed toner image of a plurality of colors on an intermediate transfer belt 8 having a movable surface. In the present embodiment, the plurality of colors are four colors: yellow (Y), magenta (M), cyan (C), and black (K). The image forming unit 30 includes four process cartridges P (PY, PM, PC, PK) that are removable from a image forming apparatus body 100. The image forming unit 30 also includes an intermediate transfer belt unit 40 including the intermediate transfer belt 8. The four process cartridges PY, PM, PC, and PK have the same structure, except for the color of the toner contained in the process cartridge P. In other words, the process cartridges PY, PM, PC, and PK form images with their respective color toners of yellow (Y), magenta (M), cyan (C), and black (K).

Each of the process cartridges PY, PM, PC, and PK includes a corresponding one of toner containers 23Y, 23M, 23C, and 23K. Also, each process cartridge P includes a corresponding one of photosensitive drums (drum-shaped electrophotographic photosensitive members) 1Y, 1M, 1C, and 1K as the image bearing member. Furthermore, each process cartridge P includes a corresponding one of charging rollers 2Y, 2M, 2C, and 2K and a corresponding one of developing rollers 3Y, 3M, 3C, and 3K. Each process cartridge P still further includes a corresponding one of cleaning blades 4Y, 4M, 4C, and 4K for the respective photosensitive drums, and a corresponding one of waste toner containers 24Y, 24M, 24C, and 24K.

Laser units 7Y, 7M, 7C, and 7K are disposed under the respective process cartridges PY, PM, PC, and PK, and each irradiate the corresponding one of the photosensitive drums 1Y, 1M, 1C, and 1K with exposure light according to image signals. The photosensitive drums 1Y, 1M, 1C, and 1K are rotatable in the direction indicated by the arrows (clockwise direction) in FIG. 3 at a predetermined peripheral speed. Each of the photosensitive drums 1Y, 1M, 1C, and 1K is charged to a predetermined negative potential by applying a predetermined negative voltage to the corresponding one of the charging rollers 2Y, 2M, 2C, and 2K. Then, the photosensitive drums 1Y, 1M, 1C, and 1K are subjected to scanning exposure with a corresponding one of the laser units 7Y, 7M, 7C, and 7K to form an electrostatic latent image on the photosensitive drums.

The resulting electrostatic latent images are developed (reversely developed) by applying a predetermined negative voltage to the developing rollers 3Y, 3M, 3C, and 3K. Thus, color toner images of yellow, magenta, cyan, and black (images formed with toners having a negative potential) are formed on the respective photosensitive drums 1Y, 1M, 1C, and 1K (step of forming a toner image by development).

The intermediate transfer belt unit 40 includes a flexible endless intermediate transfer belt 8, and a set of driving roller 9 and a driven roller 10 that hold and stretch the intermediate transfer belt 8 therebetween. Primary transfer rollers (primary transfer members) 6Y, 6M, 6C, and 6K are disposed in the inner side of the intermediate transfer belt 8 so as to oppose the respective photosensitive drums 1Y, 1M, 1C, and 1K and are each in contact with the corresponding photosensitive drum with the intermediate transfer belt 8 therebetween. Each of the contact portions of the photosensitive drums with the intermediate transfer belt 8 is a primary transfer nip portion. A transfer voltage is applied to the primary transfer rollers 6 with a voltage application device (not shown).

The intermediate transfer belt 8 is rotated (moved) in the direction indicated by arrow A shown in FIG. 3 (anticlockwise direction) at a peripheral speed corresponding to the rotational speed of the photosensitive drums by the rotation of the driving roller 9. In the Examples described herein later, the peripheral speed was set to 210 mm/s. The toner images formed on the respective photosensitive drums 1Y, 1M, 1C, and 1K are transferred (primarily) onto the intermediate transfer belt 8 and thus superimposed one on another at the primary transfer nip portions by applying a positive voltage to the primary transfer rollers 6Y, 6M, 6C, and 6K (step of primary transfer).

In other words, a yellow, a magenta, a cyan, and a black toner image are superimposed in this order to form a superimposed toner image on the surface of the intermediate transfer belt 8. The intermediate transfer belt 8 continues rotating (moving) to convey the superimposed toner image to a secondary transfer nip portion that is the portion at which the intermediate transfer belt 8 comes into contact with the secondary transfer roller (transfer medium) 11.

A feeding/conveying device 12 includes a feeding roller 14 adapted to feed a sheet-like transfer medium S from a transfer medium cassette 13 containing or holding sheet-like transfer media S, and a pair of conveying rollers 15 adapted to convey the fed transfer medium S. The transfer medium S conveyed from the feeding/conveying device 12 is introduced to the secondary transfer nip portion at a controlled predetermined timing by the function of a pair of resist rollers 16 and is thus pinched at the secondary transfer nip portion. A positive voltage is applied to the secondary transfer roller 11. Thus, the four-color superimposed toner image on the intermediate transfer belt 8 is transferred (secondarily) to the transfer medium S pinched at the secondary transfer nip portion (step of secondary transfer).

The transfer medium S onto which the superimposed toner image has been transferred is introduced to a fuser 17 acting as a fixing section. The transfer medium S to which the superimposed toner image has been fixed by heating with the fuser 17 is ejected onto an ejection tray 50 by a pair of ejecting rollers 20.

The toner (residual toner) remaining on the photosensitive drums 1Y, 1M, 1C, and 1K after the primary transfer of the toner images from the photosensitive drums to the intermediate transfer belt 8 is removed by cleaning with respective drum cleaning blades 4Y, 4M, 4C, and 4K. Also, the toner (residual toner) remaining on the intermediate transfer belt 8 after the secondary transfer of the superimposed toner image from the intermediate transfer belt 8 to the transfer medium S is removed by cleaning with an intermediate transfer belt cleaning blade 21 in contact with the intermediate transfer belt 8 in the counter direction. The removed toner is collected in a waste toner container 22.

Intermediate Transfer Member

The intermediate transfer member disclosed herein has a charge of 3.0 nC/g or less in terms of absolute value at the surface thereof when charged by a slanted charging method. When the intermediate transfer member is charged to less than 3.0 nC/g, the amount of charge transfer between the intermediate transfer member and the toner is reduced. This increases the efficiency of secondary transfer and improves the uniformity of the resulting image. The charge at the surface of the intermediate transfer member applied by a slanted charging method is measured as described herein later.

The intermediate transfer belt 8, or intermediate transfer member, will be further described below.

Figure 5:
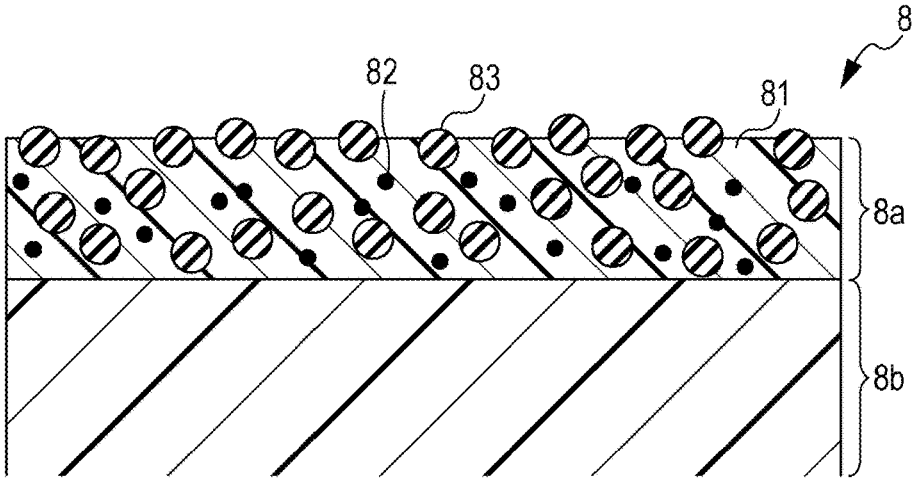
FIG. 5 is a schematic sectional view illustrating the layers of an intermediate transfer belt.

FIG. 5 is a schematic sectional view illustrating the layers of an intermediate transfer belt. The intermediate transfer belt 8 shown in FIG. 5 includes a base layer 8*b* and a surface layer 8*a*. The surface layer 8*a* is a layer closer than the base layer 8*b* to the outer peripheral surface of the intermediate transfer belt 8 and functions to support and carry the toner images primarily transferred from the photosensitive drums on the surface thereof.

The base layer 8*b* may be made of a thermoplastic resin. Examples of the thermoplastic resin include polycarbonate, poly(vinylidene fluoride) (PVDF), polyethylene, polypropylene, poly(4-methylpentene-1), polystyrene, polyamide, polysulfone, polyarylate, poly(ethylene terephthalate), poly (butylene terephthalate), poly(ethylene naphthalate), poly (butylene naphthalate), poly(phenylene sulfide), poly(ether sulfone), poly(ether nitrile), thermoplastic polyimide, poly (ether ether ketone), thermotropic liquid crystal polymer, and polyamic acid. These thermoplastic resins may be used singly or in combination.

The base layer 8*b* may be formed by molding, such as inflation molding, cylindrical extrusion molding, or injection stretch blow molding, of a mixture of the thermoplastic resin with an electrically conductive material prepared by, for example, melt blending.

The surface layer 8*a* may contain an acrylic resin as a binder. More specifically, the surface layer 8*a* of the intermediate transfer belt 8 may contain an acrylic resin as the major component of the binder. The major component in this case implies that it accounts for 50% by mass or more of the binder in the surface layer 8*a*.

In the present disclosure, the matrix of the surface layer 8*a* may contain a curable resin 81 that is cured by being irradiated with heat, light such as UV light, or an energy beam, such as an electron beam. For example, the curable resin may be an acrylic resin prepared by curing an acrylic copolymer having an unsaturated double bond. The acrylic copolymer having an unsaturated double bond may be, for example, an acrylic UV-curable resin OPSTAR Z7501 produced by JSR.

The intermediate transfer belt 8 used in the Examples described herein later has a surface layer (cured film) 8*a* formed by curing a coating liquid containing a UV-curable monomer and/or oligomer component by irradiation with an energy beam.

The surface layer 8*a* may further contain an electrically conductive material (conductive filler or electric resistance adjusting agent) 82 for controlling the electric resistance. The electrically conductive material 82 may be, for example, an electron-conductive material or an ion-conductive material.

The electron-conductive material may be a carbon-based conductive filler in the form of particles, fiber, or flakes, such as carbon black, PAN-based carbon fiber, or pulverized expanded graphite. The electron-conductive material may be metal-based conductive filler of silver, nickel, copper, zinc, aluminum, stainless steel, iron, or the like in the form of particles, fiber, or flakes. Alternatively, the electron-conductive material may be metal oxide-based particulate conductive filler of zinc antimonate, antimony-doped tin oxide, antimony-doped zinc oxide, tin-doped indium oxide, aluminum-doped zinc oxide, or the like.

The ion-conductive material may be, for example, ionic liquid, electroconductive oligomer, or a quaternary ammonium salt.

One or more of the above-cited electrically conductive materials may be used singly or in combination. An electron-conductive material and an ion-conductive material may be mixed. In an embodiment, a metal oxide-based particulate conductive filler (for example, submicron or smaller particles) may be beneficially used because a small amount of addition thereof is sufficient.

From the viewpoint of enhancing transfer efficiency and reducing the friction with the cleaning blade 21 for the intermediate transfer belt 8, surface layer particles 83 may be added to the surface layer 8*a*. The surface layer particles 83 may act as a solid lubricant and may be insulative.

Examples of the surface layer particles 83 include polytetrafluoroethylene (PTFE) particles, trifluorochloroethylene particles, tetrafluoroethylene propylene hexafluoride resin particles, vinyl fluoride resin particles, vinylidene fluoride resin particles, ethylene difluoride dichloride resin particles, graphite fluoride particles, particles of copolymers of any of these materials, and other fluorine-containing particles.

The surface layer particles 83 may be composed of a single type of particles or a mixture of two or more types of particles.

The surface layer particles 83 may be a solid lubricant, such as silicone resin particles, silica particles, or molybdenum disulfide particles. In an embodiment, polytetrafluoroethylene (PTFE) particles may be beneficially used as the surface layer particles 83. The surfaces of PTFE particles have a low friction coefficient, and this is beneficial for reducing the friction between the intermediate transfer belt 8 and the member that will come into contact with the surface of the intermediate transfer belt 8. The member that will come into contact with the surface of the intermediate transfer belt 8 may be the intermediate transfer belt cleaning blade 21. The PTFE particles may be produced by, for example, emulsion polymerization.

The surface layer 8*a* may be formed according to the following method.

A coating liquid for forming the surface layer is prepared by mixing zinc antimonate particles as an electrically conductive material and PTFE particles as a solid lubricant into an acrylic copolymer having an unsaturated double bond, and blending the materials for dispersing in each other by using a high-pressure emulsifying disperser. This coating liquid is applied onto the base layer 8*b* to form the surface layer 8*a* by, for example, a coating method selected from a variety of methods including dip coating, spray coating, roll coating, and spin coating.

The volume resistivity of the intermediate transfer belt 8 may be of $1\times10^{9}$ Ω·cm to $1\times10^{12}$ Ω·cm from the viewpoint of satisfactory image formation. The volume resistivity mentioned herein is a value measured with a resistivity meter Hiresta UPMCP-HT450 manufactured by Mitsubishi Chemical at 23.5° C. and 60% RH.

Figure 4:
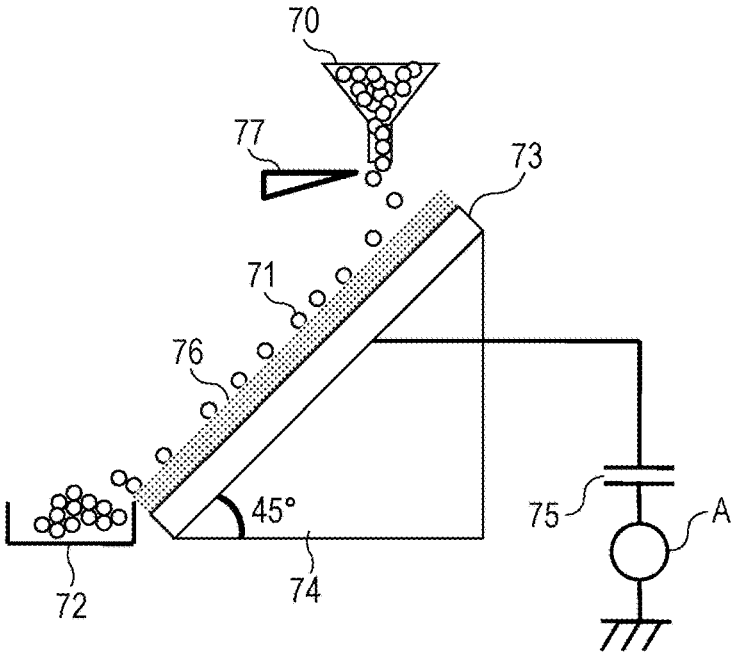
FIG. 4 is a schematic sectional view of a measurement system used in a slanted charging method.

Measurement in Slanted Charging Method:

FIG. 4 is a schematic sectional view of a measurement system used in the slanted charging method.

First, a metal plate 73 is secured to a base 74 having a slope of 45° with respect to the horizontal direction. The rear side of a specimen 76 prepared by cutting the intermediate transfer belt into a piece of 75 mm×95 mm is secured to the surface of the metal plate 73 with an electrically conductive double-sided tape X-7001 manufactured by 3M. A carrier 71 (N-01, standard negative carrier of the Imaging Society of Japan) in a funnel 70 above the metal plate 73 is dropped onto the intermediate transfer belt specimen 76 by opening a shutter 77 for 20 s in an environment of 23° C. and 50% RH. After dropping, the carrier (M g) is weighed on an electronic balance 72, and the amount of charge Q (nC) is measured with a Q meter 75 disposed between the metal plate 73 and the ground. Thus, charge Q/M (nC/g) is calculated from the weight M of the carrier and the charge amount Q (nC).

Toner

The toner used in the embodiments of the present disclosure will now be described.

The backscattered electron image is obtained under the condition where the surface of the toner particles can be shown, as described herein later. The backscattered electron images are taken under the condition where the electron penetration depth and the X-ray generation depth for each element, approximately estimated from the Kanaya-Okayama equation, are about several tens of nanometers.

In the present disclosure, backscattered electron images of a square area 1.5 μm on a side of the surface of toner particles are taken by observing the surface of the toner particles including a surface layer containing an organosilicon polymer by scanning electron microscopy. Thus, a brightness histogram of the number of pixels with reference to 256 levels of brightness on the horizontal axis thereof is obtained from the backscattered electron images. In this instance, the histogram has two local maximums P1 and P2 and a local minimum V between P1 and P2.

In the brightness histograms, the dark (black) area has lower brightness, and the bright (white) area has higher brightness. Backscattered electron images obtained by scanning electron microscopy are called "compositional images", in which the lower atomic number the element has, the brighter the element is shown. Since the toner particle has a surface layer containing an organosilicon polymer, the local maximum P1 with a lower brightness is derived from the base material of the toner particle, and the local maximum P2 with a higher brightness is derived from the organosilicon polymer.

Figure 1A:
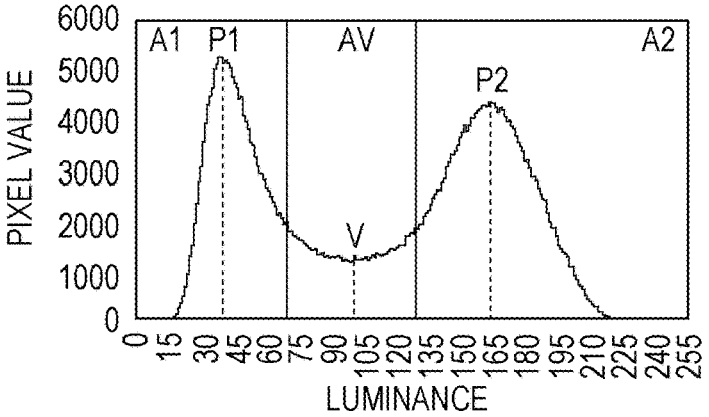
FIGS. 1A to 1C are each a brightness histogram obtained from a backscattered electron image of the surface of toner particles.
Figure 1B:
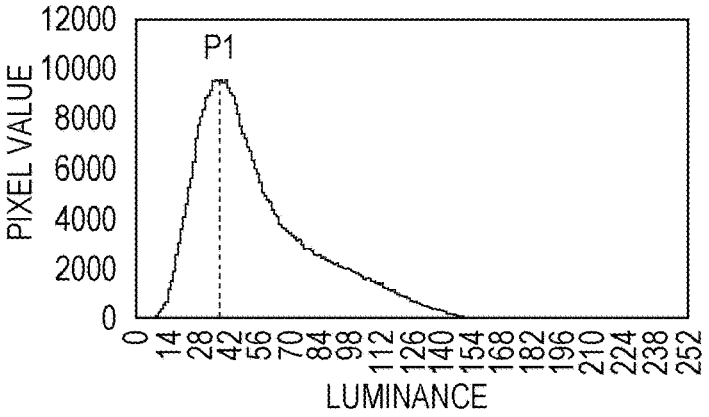

The base material of the toner particle disclosed herein is a composition containing carbon-based components in the toner particle, including the binder resin and the releasing agent. Whether P2 is derived from the organosilicon polymer can be checked by superimposing the elemental mapping image obtained energy dispersive X-ray analysis (EDS) and scanning electron microscopy and the backscattered electron image. The bimodal histogram having the local maximum P1 derived from the base material of the toner particles, the local maximum P2 derived from the organosilicon polymer, and the local minimum V between P1 and P2, as shown in, for example, FIG. 1A, is one of the requirements in the present disclosure. The unimodal brightness histogram having a single local maximum (P1 or P2) and no local minimum V, as shown in FIG. 1B, does not satisfy the requirement.

In addition, in the embodiments of the present disclosure, P1 lies in a brightness range of 20 to 70, and P2 lies in a brightness range of 130 to 230. When the brightness of P1 and P2 are distant to some extent and the distance therebetween is within a certain range, the overlap between the peak 1 with local maximum P1 and the peak 2 with local maximum P2 is small, and the separation of the peaks is good.

As described above, P1 is derived from the base material of the toner particle, and P2 is derived from the organosilicon polymer. When the separation of peak 1 and peak 2 is good, the base material and the organosilicon polymer of the toner particle are efficiently localized to respective positions, functioning effectively as described herein later. In an embodiment, P1 may lie in a brightness range of 20 to 60, and P2 may lie in a brightness range of 140 to 230.

In the present disclosure, the number of pixels of P1 and the number of pixels of P2 are each 0.50% or more relative to the total number of pixels of the backscattered electron image. With reference to the brightness V1 of the local minimum V, the total number A1 of pixels with a brightness of 0 to (V1−30), the total number AV of pixels with a brightness of (V1−29) to (V1+29), and the total number A2 of pixels with a brightness of range of (V1+30) to 255 satisfy the following relationships (1) and (2):

$$(A1/AV)\geq1.50 \quad (1); \text{ and}$$

$$(A2/AV)\geq1.50 \quad (2),$$

as shown in, for example, FIG. 1A.

Figure 1C:
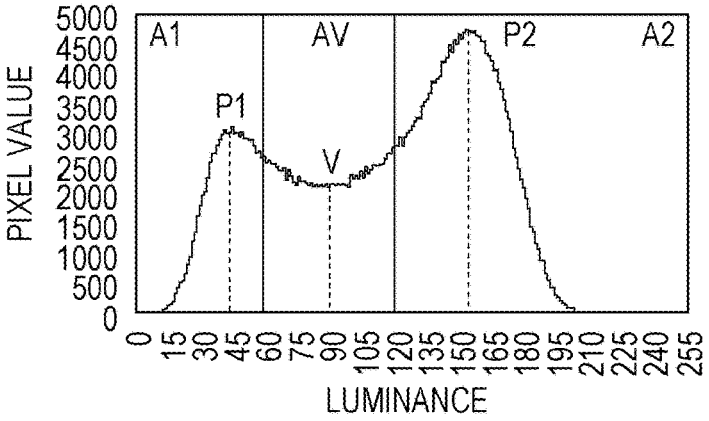

Brightness histograms as shown in FIG. 1C that do not satisfy the relationships (1) and (2) are outside the scope of the present disclosure. The major component of the total number A1 of pixels with a brightness of 0 to (V1−30) is the peak 1 having the local maximum P1, and the major component of the total number A2 of pixels with a brightness of (V1+30) to 255 is the peak 2 having the local maximum P2.

Since P1 is derived from the base material of the toner particle while P2 is derived from the organosilicon polymer, as described above, each pixel included in the total number A1 is imputed to the base material of the toner particle, and each pixel included in the total number A2 is imputed to the organosilicon polymer.

More specifically, as P1 and A1 are larger, a larger amount of the base material is present at the surface of the toner particle, and as P2 and A2 are larger, a larger amount of the organosilicon polymer is present at the surface of the toner particle. Consequently, thin paper does not stick easily to the fuser even during fixing at low temperature, and nonuniform transfer is unlikely to occur even after repetitive use in a high-temperature, high-humidity environment.

When the base material of the toner particle is present sufficiently at the surface of the toner particle, the releasing agent exudes easily from the base material of the toner particle even if the fixing temperature is low. Although thin paper is likely to stick to a member of the fuser, the thin paper is easily separated from the fuser member by an appropriate amount of the releasing agent exuded from the base material of the toner particles during fixing.

When the number of pixels of P1 is 0.50% or more relative to the total number of the pixels of the backscattered electron image and relationship (1):

$$(A1/AV) \geq 1.50 \quad (1)$$

holds true, the toner reduces the sticking of thin paper to the fuser during fixing at low temperature. From the viewpoint of reducing the sticking of thin paper during fixing at low temperature, it is beneficial that the number of pixels of P1 be of 0.70% to 5.00% relative to the total number of the pixels of the backscattered electron image, and that the following relationship (3):

$$4.00(A1/AV) \geq 1.70 \quad (3)$$

hold true.

On the other hand, when the organosilicon polymer is present sufficiently at the surface of the toner particle, non-static adhesion of the toner to the image bearing member (photosensitive member) or the intermediate transfer member can be kept low during transfer even in a high-temperature, high-humidity environment. Low non-static adhesion leads to improved response to transfer voltage, and consequently, nonuniform transfer is reduced.

The term nonuniform transfer used herein refers to a defective image having an in-plane nonuniformity formed by transfer failure of the toner occurring randomly when an image with a uniform density is output.

The organosilicon polymer can form a rough surface with a roughness as fine as several nanometer level or a roughness of several tens to several hundred nanometer level while keeping covering the surface of the toner particle at a certain level or more. In addition, an organosilicon polymer containing a hydrophobic organic group, such as a hydrocarbon group, whose chemical structure will be described in detail herein later, reduces the surface energy of the toner particle.

Probably, such an organosilicon polymer present at the surfaces of the toner particles acts as an effective spacer to reduce the frequency of contact of the base material of the toner particles with the members of the apparatus and the adhesion of the base material when the base material comes into contact with any member of the apparatus. Also, the organosilicon polymer containing a hydrophobic organic group, such as a hydrocarbon group, helps stable charging in a high-temperature, high-humidity environment. The organosilicon polymer may have a siloxane bond. Such an organosilicon polymer can be present at the surface of the toner particle as a surface layer having a strong covalent bond, enhancing the durability of the toner compared to external additives.

When the number of pixels of P2 is 0.50% or more relative to the total number of the pixels of the backscattered electron image and relationship (2):

$$(A2/AV) \geq 1.50 \quad (2)$$

holds true, the toner reduces nonuniform transfer that may occur after repetitive use in a high-temperature, high-humidity environment.

Also, when the number of pixels of P2 is of 0.70% to 5.00% relative to the total number of the pixels of the backscattered electron image and the following relationship (4):

$$4.00(A2/AV) \geq 1.70 \quad (4)$$

holds true, the toner further reduces nonuniform transfer that may occur after repetitive use in a high-temperature, high-humidity environment.

VA in relationships (1) to (4) will now be described. In the present disclosure, when the brightness histogram of the backscattered electron image is bimodal as described above, it is beneficial that the two peaks derived from the base material and the organosilicon polymer of the toner particle be independent of each other. In this case, the two peaks hardly have an overlap, AV including the local minimum V decreases infinitely.

In practice, however, the two peaks are connected, and AV has a certain number of pixels. The pixels included in AV each have a gray value including the components of the base material and the organosilicon polymer of the toner particle migrating from the pixels in A1 and A2.

More specifically, this is the case where the organosilicon polymer is present at the surface of the toner particle as a thin film with a thickness of several nanometers or where a low-melting-point or low-molecular-weight component of the base material of the toner particle melts and then forms a film on the surface of the organosilicon polymer. In this case, the advantageous effects of the base material and the organosilicon polymer decrease compared to the case where the base material and the organosilicon polymer in the toner particle are localized to respective local positions with a high purity.

As AV reduces, A1 and A2 increase, and the base material and the organosilicon polymer are efficiently localized to respective positions in the toner particle. Thus is achieved an image forming apparatus that does not easily cause thin paper to stick to the fuser even during fixing at low temperature, and does not easily allow nonuniform transfer even after repetitive use in a high-temperature, high-humidity environment.

The brightness and the number of pixels of P1 and P2, the brightness V1 of the local minimum V, and the total numbers A1, A2, and AV of pixels can be controlled by the monomer(s) of the organosilicon polymer. These values may be controlled by the reaction temperature, the reaction time, the solvent and the pH for synthesizing the organosilicon polymer.

The organosilicon polymer at the surface of the toner particles may form a network structure having a mesh defined by particles defined by pixels with a brightness of 0 to (V1−30). When a backscattered electron image of a square area 1.5 μm on a side of the surface of the toner particles is obtained by observing the surface of the toner particles by scanning electron microscopy and particles defined by the pixels with a brightness of 0 to (V1−30) (hereinafter referred to as particles A1) are analyzed, these particles may have a number average area of $2.00\times10^3$ $nm^2$ to $1.00\times10^4$ $nm^2$, and a number average Feret diameter of 60 nm to 200 nm. In an embodiment, the number average area of these particles may be from $2.00\times10^3$ $nm^2$ to $8.00\times10^3$ $nm^2$, and the number average Feret diameter may be from 60 nm to 150 nm.

As described above, A1 is imputed to the base material of the toner particle. When the organosilicon polymer at the surface of the toner particles forms a network structure, the pixel portions (represented as white) with a brightness of (V1–29) to 255 define the lines of the net, and the particles (particles A1) defined by the pixel portions (represented as black) with a brightness of 0 to (V1–30), where the organosilicon polymer is not present, define the mesh of the network structure and are detected as discrete particles. The size of the mesh of the network structure can be estimated by calculating the area and the Feret diameter of the particles based on the analysis of particles A1. The melting of the binder resin in the toner particle and the exuding of the releasing agent occur in or from particles A1 that form the portion of the base material of the toner particle.

Hence, when the area and the Feret diameter of particles A1 have certain sizes as the results of the analysis of particles A1, the binder resin in the base material of the toner particle melts favorably, and the releasing agent exudes from the base material favorably. Thus, such a toner exhibits good fixability at low temperature.

The term Feret diameter used herein refers to the largest length of the line segments between any two points on the boundary around a selected region. When the area of the particles is $2.00\times10^3$ $nm^2$ or more, or when the Feret diameter of the particles is 60 nm or more, the toner allows the binder resin to melt sufficiently and the releasing agent to exude sufficiently. This is advantageous for low-temperature fixability in view of, particularly, blister.

On the other hand, when the area of the particles is $1.00\times10^4$ $nm^2$ or less, or when the Feret diameter of the particles is 200 nm or less, the toner allows the binder resin to melt appropriately and the releasing agent to exude appropriately. This is advantageous for low-temperature fixability in view of, particularly, hot offset.

The area and the Feret diameter of the particles can be controlled by the monomer(s) of the organosilicon polymer, and the reaction temperature, the reaction time, the solvent, and the pH for synthesizing the organosilicon polymer.

It can be checked by the following manner whether the organosilicon polymer in the surface layer of the toner particle forms a network structure having a mesh defined by particles defined by pixels with a brightness of 0 to (V1–30).

Figure 2A:
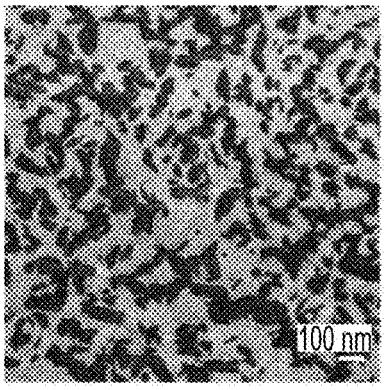
FIGS. 2A, 2A' and 2B are each a backscattered electron image or a binarized image of the surface of toner particles, showing whether or not the surface of the toner particles has a network structure.
Figure 2A:
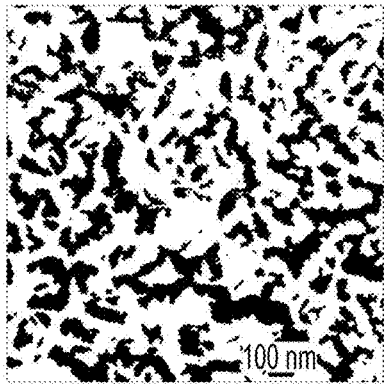

If a binarized image obtained from the backscattered electron image, in which the pixel portions with a brightness of 0 to (V1–30) are represented as black, has a shape as shown in FIG. 2A', it is determined that the organosilicon polymer forms a network structure.

Figure 2B:
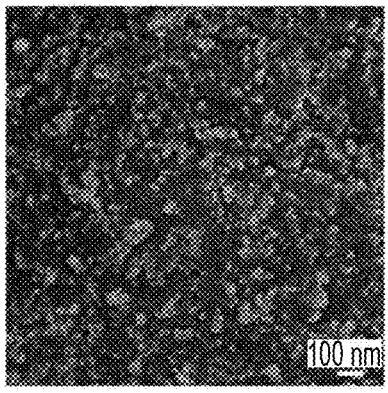

When the organosilicon polymer at the surface of the toner particle does not have a network structure, as shown in FIG. 2B, the pixel portions (represented as white) with a brightness of (V1–29) to 255 are detected as discrete particles, and the particles (particles A1) defined by the pixel portions (represented as black) with a brightness of 0 to (V1–30), where the organosilicon polymer is not present, define the lines of the net. More specifically, if the organosilicon polymer at the surface of the toner particle does not form a network structure, the area and the Feret diameter of particles A1 tend to be large.

The organosilicon polymer may be a polymer having a structure represented by the following formula (RaT3) (structure surrounded by a dashed line):

(RaT3)

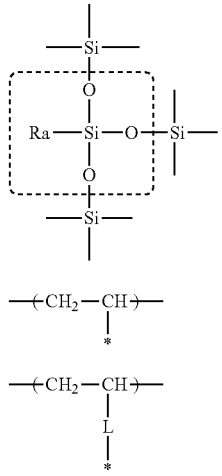

In formula (RaT3), Ra represents a hydrocarbon group (such as alkyl) having a carbon number of 1 to 6, or a unit represented by formula (i) or (ii) shown above. In formulas (i) and (ii), * represents a bonding site to the silicon atom (Si) in the structure of formula (RaT3). In formula (ii), L represents an alkylene group (such as methylene) or an arylene group (such as phenylene).

The hydrocarbon group Ra having a carbon number of 1 to 6 may be an unsaturated hydrocarbon group, such as a vinyl group.

In formula (RaT3), one of the four valence electrons of the silicon atom (Si) is involved in the bonding to Ra, and the other three are each involved in the bonding to an oxygen atom (O). The oxygen atom (O) is in the state in which the two valence electrons are each involved in the bonding to a silicon atom (Si), hence forming a siloxane bond (Si—O—Si). This structure, in which two silicon atoms (Si) have three oxygen atoms (O), is represented as $—SiO_{3/2}$.

If one of the oxygen atoms is a part of a silanol group, the structure of the organosilicon polymer is represented by $—SiO_{2/2}—OH$. If two of the oxygen atoms are each a part of a silanol group, the organosilicon polymer is represented by $—SiO_{1/2}(—OH)_2$. In the comparison of these structures, the organosilicon polymer in which a larger number of oxygen atoms form crosslinks with silicon atoms has a structure closer to silica represented by $SiO_2$. Accordingly, the more the $—SiO_{3/2}$ structure, the lower the surface free energy of the toner particle. Such a structure is effective in environmental stability of the toner and against contamination of the members of the apparatus.

In addition, Ra, which is a hydrophobic organic group, keeps the surface free energy of the toner particle low and is effective in environmental stability of the toner.

The presence of the siloxane portion ($—SiO_{3/2}$) in formula (RaT3) can be checked by $^{29}$Si-NMR measurement of the tetrahydrofuran-insoluble fraction of the toner particles.

The presence of the Ra in formula (RaT3) can be checked by $^{13}$C-NMR measurement of the tetrahydrofuran-insoluble fraction of the toner particles.

The above-described structure can be controlled by the monomer(s) of the organosilicon polymer and the amount thereof, and the reaction temperature, the reaction time, the solvent and the pH for synthesizing the organosilicon polymer.

The organosilicon polymer may be produced by a sol-gel process. In the sol-gel process, a metal alkoxide $M(OR)_n$ (wherein M represents a metal atom, O represents an oxygen atom, R represents a hydrocarbon group, and n represents the oxidation number of the metal atom), which is the starting material, is subjected to hydrolysis and polycondensation in a solvent, thus formed into a sol and then a gel. The sol-gel process is known as a method for producing, for example, glass, ceramics, organic-inorganic hybrids, and nanocomposites. The sol-gel process enables a liquid phase to be formed into a functional material in the form of a surface layer, fiber, a bulk of matter, or fine particles at a low temperature. The organosilicon polymer may be produced by hydrolysis and polycondensation of a silicon compound such as alkoxysilane (beneficially, an organosilicon compound represented by formula (Z) shown below).

The sol-gel process starts from a solution, and the solution is gelled and formed into an intended material. This process can form fine structures and fine shapes. If the toner particles are produced in an aqueous medium, in particular, the sol-gel process helps the hydrophilicity of the hydrophilic group, such as the silanol group, of the organosilicon compound so that the organosilicon polymer can be present at the surfaces of the toner particles. The fine structures and the fine shapes may be controlled by the reaction temperature, the reaction time, the solvent and pH in the reaction, the organosilicon compound and the amount thereof, and the like.

In the reaction in the sol-gel process, the state of the siloxane bond varies depending on the acidity of the reaction medium. More specifically, if the reaction medium is acid, the hydrogen ion is electrophilically added to the oxygen of a reactive group (for example, alkoxy). Then, the oxygen atom in water coordinates to the silicon atom and is then formed into a hydroxy group by a substitution reaction. If water is present sufficiently, a single hydrogen ion attacks one oxygen atom of the reactive group (for example, alkoxy). Thus, the hydrogen content and the number of reaction groups in the reaction medium decrease as the reaction proceeds. Accordingly, the reaction speed of the substitution reaction forming the hydroxy group decreases. Consequently, a polycondensation reaction occurs before all the reactive groups attached to the silane are completely hydrolyzed, easily forming a linear or two-dimensional polymer.

In contrast, if the reaction medium is alkaline, the hydroxy ion is added to the silicon atom to form a 5-ligand intermediate. Thus, all the reactive groups (for example, alkoxy) become likely to separate and be substituted by silanol groups. In particular, if an organosilicon compound in which three or more reactive groups are contained in one silane portion is used, hydrolysis and polycondensation occur three-dimensionally to form an organosilicon polymer having many three-dimensional crosslinks. In addition, this reaction is completed in a short time.

Thus, for producing an organosilicon polymer, it is beneficial that a sol-gel reaction proceeds in an alkaline reaction medium. More specifically, the organosilicon polymer is produced in an aqueous medium, the medium may have a pH of 8.0 or more. Thus, an organosilicon polymer having a high strength and high durability can be produced.

The organosilicon polymer at the surface of the toner particle may be a polycondensate of the organosilicon compound represented by the following formula (Z):

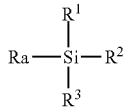

(Z)

In formula (Z), Ra represents an alkyl group having a carbon number of 1 to 6 or a structure represented by the following formula (iii) or (iv). $R^1$, $R^2$, and $R^3$ each represent a halogen atom, a hydroxy group, an acetoxy group, or an alkoxy group (beneficially, an alkoxy group having a carbon number of 1 to 3).

$$*\text{-}CH{=}CH_2 \quad \text{(iii)}$$

$$*\text{-}L\text{-}CH{=}CH_2 \quad \text{(iv)}$$

In formulas (iii) and (iv), *represents a bonding site to the silicon atom (Si) in the formula (Z). In formula (iv), L represents an alkylene group (such as methylene) or an arylene group (such as phenylene).

The organic group represented by Ra increases hydrophobicity, contributing to producing environmentally stable toner particles.

$R^1$, $R^2$, and $R^3$ each represent a halogen atom, a hydroxy group, an acetoxy group, or an alkoxy group and hereinafter may be referred to as the reactive groups. These reactive groups will be hydrolyzed and form crosslinks by addition polymerization and polycondensation, thus contributing to the production of a toner resistant to contamination and durable against development. The reactive groups may be an alkoxy group because its hydrolysis is moderate at room temperature and from the viewpoint of precipitating at the surfaces of the toner particles and covering the surfaces. In an embodiment, the alkoxy group may be methoxy or ethoxy. The hydrolysis, addition polymerization and polycondensation of $R^1$, $R^2$ and $R^3$ can be controlled by the reaction temperature, the reaction time, and the solvent and pH for the reaction.

For producing the organosilicon polymer, one or more of the organosilicon compounds having the three reactive groups ($R^1$, $R^2$, and $R^3$) in the molecular structure of formula (Z) except for Ra (hereinafter referred to as trifunctional silane) may be used.

Examples of the organosilicon compound represented by formula (Z) include:

trifunctional vinylsilanes (having three reactive groups), such as vinyltrimethoxysilane, vinyltriethoxysilane, vinyldiethoxysilane, vinylethoxydimethoxysilane, vinyltrichlorosilane, vinylmethoxydichlorosilane, vinylethoxydichlorosilane, vinyldimethoxychlorosilane, vinylmethoxyethoxychlorosilane, vinyldiethoxychlorosilane, vinyltriacetoxysilane, vinyl diacetoxymethoxysilane, vinyldiacetoxyethoxysilane, vinylacetoxydimethoxysilane, vinylacetoxymethoxyethoxysilane, vinylacetoxydiethoxysilane, vinyltriethoxysilane, vinylmethoxydihydroxysilane, vinylethoxydihydroxysilane, vinyldimethoxyhydroxysilane, vinylethoxymethoxyhydroxysilane, and vinyldiethoxyhydroxysilane;

trifunctional allylsilanes, such as allyltrimethoxysilane, allyltriethoxysilane, allyldiethoxysilane, allylethoxydimethoxysilane, allyltrichlorosilane, allylmethoxydichlorosilane, allylethoxydichlorosilane, allyldimethoxychlorosilane, allylmethoxyethoxychlorosilane, allyldiethoxychlorosilane, allyltriacetoxysilane, allyl diacetoxymethoxysilane, allyldiacetoxyethoxysilane, allylacetoxydimethoxysilane, allylacetoxymethoxyethoxysilane, allylacetoxydiethoxysilane, allyltriethoxysilane, allylmethoxydihydroxysilane, allylethoxydihydroxysilane, allyldimethoxyhydroxysilane, allylethoxymethoxyhydroxysilane, and allyldiethoxyhydroxysilane;

trifunctional methylsilanes, such as methyltrimethoxysilane, methyltriethoxysilane, methyldiethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyl diacetoxymethoxysilane, methyldiacetoxyethoxysilane, methylacetoxydimethoxysilane, methylacetoxymethoxyethoxysilane, methylacetoxydiethoxysilane, methyltriethoxysilane, methylmethoxydihydroxysilane, methylethoxydihydroxysilane, methyldimethoxyhydroxysilane, methylethoxymethoxyhydroxysilane, and methyldiethoxyhydroxysilane;

trifunctional ethylsilanes, such as ethyltrimethoxysilane, ethyltriethoxysilane, ethyltrichlorosilane, ethyltriacetoxysilane, and ethyltrihydroxysilane;

trifunctional propylsilanes, such as propyltrimethoxysilane, propyltriethoxysilane, propyltrichlorosilane, propyltriacetoxysilane, and propyltrihydroxysilane;

trifunctional butylsilanes, such as butyltrimethoxysilane, butyltriethoxysilane, butyltrichlorosilane, butyltriacetoxysilane, and butyltrihydroxysilane;

trifunctional hexylsilanes, such as hexyltrimethoxysilane, hexyltriethoxysilane, hexyltrichlorosilane, hexyltriacetoxysilane, and hexyltrihydroxysilane; and trifunctional phenylsilanes, such as phenyltrimethoxysilane, phenyltriethoxysilane, phenyltrichlorosilane, phenyltriacetoxysilane, and phenyltrihydroxysilane.

These organosilicon compounds may be used singly or in combination.

The proportion of the organosilicon compound of formula (Z) may be 50% by mole or more, for example, 60% by mole, relative to the total moles of the organosilicon compounds used for producing the organosilicon polymer by hydrolysis and polycondensation.

One or more of other organosilicon compounds may be used in combination with the organosilicon compound represented by formula (Z). Those organosilicon compounds may be organosilicon compounds having four reactive groups in the molecule (tetrafunctional silanes), organosilicon compounds having three reactive groups in the molecule (trifunctional silanes), organosilicon compounds having two reactive groups in the molecule (difunctional silanes), or organosilicon compounds having one reactive group in the molecule (monofunctional silanes).

More specifically, examples of the organosilicon compounds other than the organosilicon compounds of formula (Z) include:

dimethyldiethoxysilane, tetraethoxysilane, hexamethyldisilazane, 3-glycidoxyphenyltrimethoxysilane, 3-glycidoxypropylmethyldimethoxysilane, 3-glycidoxy propyl methyl diethoxysilane, 3-glycidoxypropyltriethoxysilane, 2-(3,4-epoxycyclohexyl)ethyltrimethoxysilane, 3-methacryloxy propylmethyl di methoxy silane, 3-methacryloxypropylmethyl diethoxysilane, 3-methacryloxypropyltriethoxysilane, 3-acryloxy propyl tri methoxy silane, 3-aminopropyltri methoxy silane, 3-aminopropyl trimethoxy silane, N-2-(aminoethyl)-3-aminopropyltrimethoxysilane, N-2-(aminoethyl)-3-aminopropyltriethoxysilane, N-2-(aminoethyl)-3 aminopropylmethyl dimethoxy silane, N-phenyl-3-aminopropyltrimethoxysilane, 3-ureidopropyltriethoxysilane, 3-chloropropyltrimethoxysilane, 3-anilinopropyltrimethoxysilane, 3-mercaptopropylmethyldimethoxysilane, 3-mercaptopropyltrimethoxysilane, 3-mercaptopropyltriethoxysilane, bis(triethoxysilylpropyl)tetrasulfide, trimethylsilyl chloride, triethylsilyl chloride, triisopropylsilyl chloride, t-butyldimethylsilyl chloride, N,N'-bis(trimethylsilyl)urea, N,O-bis(trimethylsilyl)trifluoroacetamide, trimethylsilyl trifluoromethanesulfonate, 1,3-dichloro-1,1,3,3-tetraisopropyldisiloxane, trimethylsilylacetylene, hexamethyldisilane, 3-isocyanatepropyltriethoxysilane, tetraisocyanatesilane, methyltriisocyanatesilane, and vinyltriisocyanatesilane.

Other constituents of the toner will now be described. The toner particle including the surface layer containing the organosilicon polymer contains a binder resin and a releasing agent, and, optionally, a coloring agent and other ingredients.

The binder resin may be selected from various resins used in toner (beneficially, amorphous resin), such as styrene-acrylic resin (for example, styrene-acrylate copolymer or styrene-methacrylate copolymer), polyester, epoxy resin, and styrene-butadiene copolymer.

The coloring agent may be, for example, a yellow pigment, such as yellow iron oxide, navel yellow, naphthol yellow S, hansa yellow G, hansa yellow 10G, benzidine yellow G, benzidine yellow GR, quinoline yellow lake, permanent yellow NCG, tartrazine lake or any other condensed azo compound, an isoindolinone compound, an anthraquinone compound, an azo metal complex, a methine compound, or an allylamide compound. More specifically, examples of such yellow pigments include C.I. Pigment Yellows 12, 13, 14, 15, 17, 62, 74, 83, 93, 94, 95, 109, 110, 111, 128, 129, 147, 155, 168, and 180.

The coloring agent may be an orange pigment, and examples thereof include permanent orange GTR, pyrazolone orange, vulcan Orange, benzidine orange G, indanthrene brilliant orange RK, and indanthrene brilliant orange GK.

Red pigments may be used, and examples thereof include colcothar, permanent red 4R, lithol Red, pyrazolone red, watching red calcium salt, lake red C, lake red D, brilliant carmine 6B, brilliant carmine 3B, Eosine lake, rhodamine lake B, alizarin lake and other condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. More specifically, examples of such red pigments include C.I. Pigment Reds 2, 3, 5, 6, 7, 23, 48:2, 48:3, 48:4, 57:1, 81:1, 122, 144, 146, 166, 169, 177, 184, 185, 202, 206, 220, 221, and 254.

Blue pigments may be used, and examples thereof include alkaline blue lake, Victoria Blue Lake, phthalocyanine blue, metal-free phthalocyanine blue, partially chlorinated phthalocyanine blue, fast sky blue, copper phthalocyanine compounds and derivatives thereof, such as indanthrone blue BG, anthraquinone compounds, and basic dye lake compounds. More specifically, examples of such blue pigments include C.I. Pigment Blues 1, 7, 15, 15:1, 15:2, 15:3, 15:4, 60, 62, and 66.

Purple pigments, such as fast violet B and methyl violet lake, may also be used.

Green pigments include, for example, Pigment Green B, malachite green lake, and final yellow green G.

White pigments include, for example, hydrozincite, titanium oxide, antimony white, and zinc sulfide.

Black pigments include, for example, carbon black, aniline black, nonmagnetic ferrite, and magnetite. Also, a black color may be produced by mixing any of the above-mentioned yellow, red, and blue coloring agents.

Coloring agents may be used singly or in combination. If two or more coloring agents are used, they may be in the form of a mixture or a solid solution.

The proportion of the coloring agent in the toner particle may be from 3.0 parts by mass to 15.0 parts by mass relative to 100 parts by mass of the binder resin or the polymerizable monomer(s) forming the binder resin.

Examples of the releasing agent include paraffin waxes; microcrystalline waxes; petrolatum and other petroleum waxes and derivatives thereof; montan waxes and derivatives thereof; hydrocarbon waxes produced by Fischer-Tropsch process and derivatives thereof; polyolefin waxes, such as polyethylene and polypropylene, and derivative thereof; natural waxes, such as carnauba wax and candelilla wax, and derivatives thereof; higher fatty alcohols; fatty acids, such as stearic acid and palmitic acid, and compounds thereof; acid amide waxes; ester waxes; ketones; hydrogenated castor oil and derivative thereof; plant waxes; animal waxes; and silicone resins. Derivatives of these waxes include oxides, block copolymers with vinyl monomers, and graft-modified forms. These releasing agents may be used singly or in combination.

The proportion of the releasing agent in the toner particle may be from 5.0 parts by mass to 30.0 parts by mass relative to 100 parts by mass of the binder resin or the polymerizable monomer(s) forming the binder resin.

The toner particle may contain a charge control agent. The proportion of the charge control agent in the toner particle may be from 0.01 part by mass to 10.0 parts by mass relative to 100 parts by mass of the binder resin or the polymerizable monomer(s) forming the binder resin.

One or more types of organic fine particles and/or inorganic fine particles may be externally added to the toner particles. The particle size of these fine particles may be 1/10 the particle size of the toner particles in view of the durability of the toner when the fine particles are added to the toner particles.

The organic or inorganic fine particles may be selected from the following:

(1) fluidity imparting agents, such as silica fine particles, alumina fine particles, titanium oxide fine particles, carbon black, and fluorinated carbons;
(2) abrasives, such as metal oxide (for example, strontium titanate, cerium oxide, alumina, magnesium oxide, and chromium oxide) fine particles, nitride (for example, silicon nitride) fine particles, carbide (for example, silicon carbide) fine particles, and metal salt (for example, calcium sulfate, barium sulfate, and calcium carbonate) fine particles;
(3) lubricants, such as fluororesin (for example, poly(vinylidene fluoride) and polytetrafluoroethylene) fine particles and fatty acid metal salt (for example, zinc stearate and calcium stearate) fine particles; and
(4) charge controllable particles, such as metal oxide (for example, tin oxide, titanium oxide, zinc oxide, and alumina) fine particles, silica fine particles, and carbon black.

The surfaces of the organic or inorganic fine particles may be hydrophobized from the viewpoint of improving the fluidity of the toner and uniformly charging the toner particles.

Hydrophobization agents for hydrophobizing the surfaces of the organic or inorganic fine particles include, for example, unmodified silicone varnish, a variety of modified silicone varnishes, unmodified silicone oil, a variety of modified silicone oils, silane compounds, silane coupling agents, other organosilicon compounds, and organotitanium compounds. These hydrophobization agents may be used singly or in combination.

Some of the methods for producing the toner will now be described in detail.

In a method first described, the surface layer is formed of the organosilicon polymer in an aqueous medium after the base material of the toner particles is produced. In this method, the organosilicon polymer is precipitated or polymerized at the surface of the base material of the toner particle, thus efficiently forming a surface layer containing the organosilicon polymer for the toner particle.

More specifically, the base material of the toner particles, containing a binder resin is prepared and is then dispersed in an aqueous medium to prepare a base material dispersion liquid. In this instance, the solids content of the base material may be from 10% by mass to 40% by mass relative to the total mass of the base material dispersion liquid. The base material dispersion liquid may be adjusted to 35° C. or more. Furthermore, the base material dispersion liquid is controlled to a pH at which the organosilicon compound is unlikely to be condensed. The pH at which the organosilicon compound is unlikely to be condensed depends on the material and is beneficially set within ±0.5 from the pH at which the reaction is least likely to proceed.

An organosilicon compound subjected to hydrolysis may be used. For example, the organosilicon compound has been hydrolyzed in another vessel in advance. In this instance, the concentration of the organosilicon compound for the hydrolysis may be such that 40 parts to 500 parts of deionized water, such as ion-exchanged water or RO water, is added to 100 parts by mass of the organosilicon compound. In an embodiment, the amount of water may be from 100 parts by mass to 400 parts by mass. The hydrolysis may be conducted for a period of 1 minute to 600 minutes under the conditions controlled to a pH of 1.0 to 7.0 and a temperature of 15° C. to 80° C.

The hydrolyzed organosilicon compound is then added to the base material dispersion liquid. The base material dispersion liquid and the liquid containing the hydrolyzed organosilicon compound are mixed with stirring, and the mixture is allowed to stand at a predetermined temperature for a predetermined time (for example, at 35° C. for a period of 3 minutes to 120 minutes). Then, the organosilicon compound may be condensed at once at a pH suitable for the condensation (for example, at a pH of 6.0 or more or 3.0 or less, beneficially 8.0 or more) and allowed to stand for a predetermined time (for example, at 35° C. or more for 60 minutes or more) to form a surface layer containing the organosilicon polymer on the base material of the toner particle.

The base material of the toner particles may be produced by any one of the following processes:

(1) Suspension polymerization process: the base material of the toner particles is produced by forming particles of a polymerizable monomer composition containing one or more polymerizable monomers capable of producing a binder resin, a releasing agent, and, optionally, a coloring agent and other additives, and then polymerizing the polymerizable monomer(s).
(2) Pulverization process: the base material of the toner particles is produced by melting and kneading a mixture of a binder resin and a releasing agent and, optionally, a coloring agent and other additives, and pulverizing the kneaded material.

(3) Dissolution suspension process: the base material of the toner particles is produced by suspending an organic phase dispersion liquid prepared by dissolving a binder resin and a releasing agent and, optionally, a coloring agent and other additives in an aqueous medium to form particles, followed by removing the organic solvent.

(4) Emulsion aggregation process: the base material of the toner particles is produced by aggregating the particles of a binder resin and a releasing agent and, optionally, the particles of a coloring agent and other additives in an aqueous medium for association.

In a method secondary described, the toner particles are formed by forming particles of a polymerizable monomer composition containing one or more polymerizable monomers capable of producing a binder resin, the organosilicon compound, and a releasing agent and, optionally, a coloring agent and other additives, and then polymerizing the polymerizable monomer(s).

In a method thirdly described, the toner particles are formed by suspending an organic phase dispersion liquid, which is prepared by dissolving or dispersing a binder resin, an organosilicon compound, and a releasing agent and, optionally, a coloring agent and other additives in an organic solvent, in an aqueous medium to form particles, followed by removing the organic solvent.

In a method fourthly described, the toner particles are formed by aggregating binder resin particles and particles containing the organosilicon compound in a sol or gel state and, optionally, the particles of a coloring agent and other additives for association.

In a method fifthly described, the surface layer containing the organosilicon compound is formed by spraying a solvent containing the organosilicon compound over the surface of the toner particles by spray drying, followed by polymerizing or drying the surface layer by hot air and cooling.

The aqueous medium used in the above-described methods or processes may be, for example, water or a mixture of water and an alcohol, such as methanol, ethanol, or propanol.

In some embodiment, the toner particles may be formed by the first method, and, particularly, the method in which the base material of the toner particle is produced by the suspension polymerization process. The suspension polymerization helps the organosilicon polymer to precipitate uniformly over the surface of the toner particle, easily improving environmental stability, developability, transferability, and persistence of these properties (persistent durability).

The suspension polymerization process will be further described in detail.

The polymerizable monomer composition may contain other resins, if necessary. After the completion of the polymerization, the resulting particles are rinsed and then collected through a filter, followed by drying to yield the base material of the toner particles. The polymerization temperature may be increased in the latter half of the polymerization process. To remove the unreacted polymerizable monomer(s) or the by-product, part of the solvent may be removed from the reaction system by evaporation in the latter half of the polymerization process or after the polymerization. After the completion of the polymerization process, a base material dispersion liquid in which the base material of the toner particles is dispersed without being subjected to rinsing, filtration, or drying may be used for forming the surface layer containing the organosilicon polymer.

Examples of the above-mentioned "other resins" include:

homopolymers of substituted or unsubstituted styrene, such as polystyrene and polyvinyl toluene;

styrene-based copolymers, such as styrene-propylene copolymers, styrene-vinyl toluene copolymers, styrene-vinyl naphthalene copolymers, styrene-methyl acrylate copolymers, styrene-ethyl acrylate copolymer, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers, and styrene-maleic acid ester copolymers; and poly(methyl methacrylate), poly(butyl methacrylate), poly(vinyl acetate), polyethylene, polypropylene, poly(vinyl butyral), silicone resin, polyester resin, polyamide resin, epoxy resin, polyacrylic resin, rosin, modified rosin, terpene resin, phenol resin, aliphatic or alicyclic hydrocarbon resins, and aromatic petroleum resin.

These resins may be used singly or in combination.

The polymerizable monomer that can be used in the above-described suspension polymerization process may be a vinyl-based polymerizable monomer, and examples thereof include:

styrene;

styrene derivatives, such as styrene, α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene;

polymerizable acrylic monomers, such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate;

polymerizable methacrylic monomers, such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate;

aliphatic methylene monocarboxylic acid esters;

vinyl esters, such as vinyl acetate, vinyl propionate, vinyl benzoate, vinyl butyrate, and vinyl formate;

vinyl ethers, such as vinyl methyl ether, vinyl ethyl ether, such as vinyl isobutyl ethyl; and vinyl methyl ketone, vinyl hexyl ketone, and vinyl isopropyl ketone.

Styrene, styrene derivatives, polymerizable acrylic monomers, polymerizable methacrylic monomers are beneficially used.

In the polymerization of the polymerizable monomers, a polymerization initiator may be added.

Examples of the polymerization initiator include:

diazo-based polymerization initiators, such as 2,2'-azobis-(2,4-divaleronitrile), 2,2'-azobis(isobutyronitrile), 1,1'-azobis(cyclohexane-1-carbonitrile), 2,2'-azobis-4-methoxy-2,4-dimethylvaleronitrile, and azobis (isobutyronitrile); and peroxide-based polymerization initiators, such as benzoyl peroxide, methyl ethyl ketone peroxide, diisopropyloxy carbonate, cumene hydroperoxide, 2,4-dichlorobenzoyl peroxide, and lauroyl peroxide.

The proportion of the polymerization initiator used may be from 0.5 part by mass to 30.0 parts by mass relative to 100 parts by mass of the polymerizable monomers.

Polymerization initiators may be used singly or in combination.

In the polymerization of the polymerizable monomers, a chain transfer agent may be used for controlling the molecular weight of the binder resin contained in the toner particle.

The chain transfer agent may be used from 0.001 part by mass to 15.0 parts by mass relative to 100 parts by mass of the polymerizable monomers.

In the polymerization of the polymerizable monomers, a crosslinkable monomer (crosslinking agent) may be used for controlling the molecular weight of the binder resin contained in the toner particle.

Examples of the crosslinkable monomer include bifunctional crosslinking agents, such as divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycols #200, #400 and #600, dipropylene glycol diacrylate, polypropylene glycol diacrylate, polyesterified diacrylate (for example, MANDA produced by Nippon Kayaku), and dimethacrylates corresponding to these diacrylates.

Polyfunctional crosslinkable monomers may also be used, and examples thereof include:

pentaerythritol triacrylate, trimethylolethane triacrylate, trimethylolpropane triacrylate, tetramethylolmethane tetraacrylate, oligoester acrylate, and methacrylate forms corresponding to these acrylate forms; and 2,2-bis(4-methacryloxy polyethoxyphenyl)propane, diallyl phthalate, triallyl cyanurate, triallyl isocyanurate, triallyl trimellitate, and diaryl chlorendate.

The proportion of the polyfunctional crosslinkable monomer used may be from 0.001 part by mass to 15.0 parts by mass relative to 100 parts by mass of the polymerizable monomer(s).

If the medium used in the suspension polymerization process is aqueous, a dispersion stabilizer may be used for dispersing the polymerizable monomer particles. Examples of the dispersion stabilizer include tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina.

An organic dispersant may be used, and examples thereof include polyvinyl alcohol, gelatin, methyl cellulose, methyl hydroxypropyl cellulose, ethyl cellulose, carboxymethyl cellulose sodium salt, and starch.

A surfactant selected from a variety of nonionic, anionic, and cationic surfactants may be used. Examples of the surfactant include sodium dodecyl sulfate, sodium tetradecyl sulfate, sodium pentadecyl sulfate, sodium octyl sulfate, sodium oleate, sodium laurate, and potassium stearate.

The physical properties of the toner used in the embodiments of the present disclosure may be measured by the following methods.

For the toner to which organic or inorganic fine particles are externally added, the organic or inorganic fine particles are removed in advance for the measurement according to the following procedure.

A concentrated sucrose solution is prepared by dissolving 160 g of sucrose (produced by Kishida Chemical) in 100 mL of ion-exchanged water being heated in hot water.

Into a centrifuge tube (50 mL) are added 31 g of the concentrated sucrose solution and 6 mL of Contaminon N (10 mass % aqueous solution of pH 7 neutral detergent for cleaning precision measuring instruments, containing a nonionic surfactant, an anionic surfactant, an organic builder, produced by FUJIFILM Wako Pure Chemical Corporation). Then, 1.0 g of toner is added into the centrifuge tube, followed by diffusing aggregates of the toner with a spatula or the like. The centrifuge tube is shaken with a shaker AS-1N (available from AS ONE Corporation) at 300 spm (strokes per min) for 20 minutes. Then, the liquid is removed into a swing rotor glass tube (50 mL) and subjected to separation in a centrifuge H-9R (manufactured by Kokusan) at 3500 rpm for 30 minutes. Thus, the toner particles and the external additive are separated.

After visually ensuring that the toner and a liquid phase are sufficiently separated, the upper phase, or toner, is collected with a spatula. The collected toner is subjected to vacuum filtration and then dried for at least 1 hour to yield a test sample. The procedure up to this is repeated several times until an amount of toner required for measurement is collected.

Procedure for Obtaining Backscattered Electron Image of the Surface of the Toner Particles:

The backscattered electron image of the surface of the toner particles is obtained by scanning electron micrography (SEM). The apparatus and the observation conditions for the SEM are as follows:

Apparatus: ULTRA PLUS (manufactured by Carl Zeiss Microscopy Company)

Acceleration voltage: 1.0 kV

WD: 2.0 mm

Aperture Size: 30.0 μm

Detection signal: EsB (energy-selective backscattered electrons)

EsB Grid: 800 V

Magnification for observation: 50,000 times

Contrast: 63.0±5.0% (reference value)

Brightness: 38.0±5.0% (reference value)

Resolution: 1024×768

Pretreatment: scattering toner particles onto a carbon tape (no vacuum deposition)

The contrast and the brightness are determined according to the following procedure.

First, the contrast is set so that two local maximums P1 and P2 in the brightness histogram can have as many pixels as possible and have a distance therebetween as large as possible.

Then, the brightness is set so that the feet of the two peaks respectively having local maximums P1 and P2 can lie within the brightness histogram. The contrast and the brightness are appropriately set as described above according to the conditions of the apparatus. The acceleration voltage and the EsB Grid are set from the viewpoint of obtaining structural information of the surface of the toner particles, preventing charge-up of undeposited sample, and selectively detecting high-energy backscattered electrons. The field of observation to be selected is around the apex at which the curvature of the toner particle is smallest.

Procedure for Checking Whether P2 is Derived from the Organosilicon Polymer:

Whether P2 is derived from the organosilicon polymer can be checked by superimposing the elemental mapping image obtained energy dispersive X-ray analysis (EDS) and scanning electron microscopy (SEM) and the backscattered electron image. The apparatus and the observation conditions for the SEM and EDS are as follows:

Apparatus (SEM): ULTRA PLUS (manufactured by Carl Zeiss Microscopy Company)

Apparatus (EDS): NORAN System 7 and Ultra Dry EDS Detector, manufactured by Thermo Fisher Scientific Acceleration voltage: 5.0 kV WD: 7.0 mm Aperture Size: 30.0 μm Detection signal: SE2 (secondary electrons)

Magnification for observation: 50000 times

Mode: Spectral Imaging

Pretreatment: scattering toner particle onto a carbon tape, followed by platinum sputtering The silicon mapping image thus obtained and the backscattered electron image are superimposed, and it is checked whether the points representing silicon atoms correspond to the bright portions of the backscattered electron image.

Preparation of Brightness Histogram:

The brightness histogram is prepared by analyzing the backscattered electron image of the surface of the toner particle with an image processing software program Image J (developed by Wayne Rashand) according to the following procedure.

First, on the Type screen in Image Menu, convert the type of the backscattered electron image of the object to be analyzed to 8-bit.

Then, in Filters submenu of Process Menu, set the Median diameter to 2.0 pixels to reduce noise in the image. Estimate the center of the backscattered electron image except the region showing the observation conditions at the bottom of backscattered electron image, and select a square area 1.5 μm on a side from the center of the backscattered electron image by using the Rectangle Tool in Toolbar.

Then, select Histgram in Analyze Menu to display a brightness histogram on a new window. Obtain the values of the brightness histogram from the List on the window. Fitting of the brightness histogram may be conducted, if necessary. Calculate the brightness and the number of pixels of the local maximums P1 and P2, the brightness V1 of the local minimum V, and the numbers of pixels A1, A2, and AV from the values of the brightness histogram.

Ten fields are observed for each sample of the toner particles according to the above-described procedure, and each average of those values is determined to be the physical property estimated from the brightness histogram.

Analysis of Particles A1:

Particles A1 are analyzed by using the backscattered electron images of the surface of the toner particles with the image processing software program Image J (developed by Wayne Rasband) according to the following procedure.

First, on the Type screen in Image Menu, covert the backscattered electron image to an 8-bit type image.

Then, in Filters submenu of Process Menu, set the Median diameter to 2.0 pixels to reduce noise in the image. Estimate the center of the backscattered electron image except the region showing the observation conditions at the bottom of backscattered electron image, and select a square area 1.5 μm on a side from the center of the backscattered electron image by using the Rectangle Tool in Toolbar.

Then, select Threshold in Adjust submenu of Image Menu. Manually select all the pixels with a brightness of 0 to (V1−30), and click Apply to obtain the binarized image. Thus, pixels A1 are represented as black. Estimate again the center of the backscattered electron image except the region showing the observation conditions at the bottom of backscattered electron image, and select a square area 1.5 μm on a side from the center of the backscattered electron image by using Rectangle Tool in Toolbar.

Then, select Scale Bar in the region showing the observation conditions at the bottom of the backscattered electron image by using Straight Line Selection Tool in Toolbar. In this state, select Set Scale in Analyze Menu to open a new window. The distance in pixels of the selected straight line is input in Distance in Pixels field. Enter the value (for example, 100) of Scale Bar in Known Distance field of the same window, then enter the unit (for example, nm) of the Scale Bar in Unit of Measurement field, and click OK to complete Set Scale.

Subsequently, select Set Measurements in Analyze Menu, and check Area and Feret's diameter. Select Analyze Particles of Analyze Menu, check Display Result, and click OK for analyzing particles.

Calculate the number averages of the area and the Feret diameter of the particles corresponding to particles A1 by using the area (Area) and the Feret diameter (Feret) shown in the newly opened Results Window.

Ten fields are observed for each sample of the toner particles according to the above-described procedure, and each average of those values is determined to be the physical property obtained based on the analysis of particles A1.

Procedure for checking whether organosilicon polymer has a network structure:

It is checked by the following procedure whether the organosilicon polymer at the surface of the toner particles forms a network structure having a mesh defined by particles defined by pixels with a brightness of 0 to (V1−30).

A binarized image of a square area 1.5 μm on a side in which pixel portions with a brightness of 0 to (V1−30) are represented as black is obtained in the same manner as in the analysis of particles A1. If the binarized image thus obtained has a shape as shown in FIG. 2A', it is determined that the organosilicon polymer forms a network structure.

Measurement of Weight-Average Particle Size (D4) of Toner Particles:

The weight-average particle size (D4) of the toner particles is measured by a pore electric resistance method with a 100 μm aperture tube, using a precise particle size distribution analyzer "Coulter Counter Multisizer 3" manufactured by Beckman Coulter and a software program Multisizer 3 Version 3. 51 supplied from Beckman Coulter with the analyzer for setting measuring conditions and analyzing measurement data. For the measurement and data analysis, the effective number of measurement channels is set to 25,000.

The electrolyte used for the measurement may be prepared by dissolving highest-quality sodium chloride in ion-exchanged water to a concentration of about 1% by mass, and, such an electrolyte is available as, for example, ISOTON II (produced by Beckman Coulter).

Before the measurement and analysis, the software is set up as described below.

On the "standard measurement (SOM) change screen (in Japanese) of the software, set the total count in the control mode to 50000 particles, and set the number of measurements to 1 and Kd to a value obtained by use of "10.0 μm standard particles" (produced by Beckman Coulter). Press the threshold/noise level measurement button to automatically set the threshold and noise level. Set Current to 1600 μA, Gain to 2, and the electrolyte to ISOTON II, and check the statement of Flush of aperture tube after measurement (in Japanese)". On the "Pulse-to-Particle Size Conversion Setting Screen (in Japanese)" of the software, set the bin distance to logarithmic particle size, the particle size bin to 256 particle size bins, and the particle size range to a range of 2 μm to 60 μm.

More specifically, the measurement is performed according to the following procedure:

(1) About 200 mL of the electrolyte solution is placed in a Multisizer-3-specific 250 mL glass round bottom beaker set on a sample stand and stirred with a stirrer rod counterclockwise at 24 revolutions per second. The dirt and air bubbles in the aperture tube are removed by the "Aperture Flush" function of the software.

(2) About 30 mL of the electrolyte solution is placed in a 100 mL glass flat bottom beaker, and about 0.3 mL of a solution prepared by diluting "CONTAMINON N" to three times its mass with ion exchanged water is added as a dispersant to the electrolyte.

(3) About 2 mL of CONTAMINON N is added to a predetermine amount of ion-exchanged water in a water tank of an ultrasonic dispersion system Tetora 150 (manufactured by Nikkaki Bios) having an electric power of 120 W, containing two oscillators of 50 kHz in oscillation frequency in a state where their phases are shifted by 180°.

(4) The beaker of (2) described above is set to a beaker securing hole of the ultrasonic dispersion system, and the ultrasonic dispersion system is started. Then, the level of the beaker is adjusted so that the resonance of the surface of the electrolyte in the beaker can be largest.

(5) In a state where ultrasonic waves are applied to the electrolyte in the beaker of (4), about 10 mg of toner particles is added little by little to the electrolyte and dispersed. Such ultrasonic dispersion is further continued for 60 seconds. For the ultrasonic dispersion, the water temperature in the water tank is controlled from 10° C. to 40° C.

(6) The electrolyte of (5) described above, in which the toner particles are dispersed, is dropped with a pipette into the round bottom beaker of (1) set on the sample stand to adjust the measured concentration to about 5%. Then, the measurement is performed until the number of measured particles comes to 50000.

(7) The measurement data are analyzed with the software program, and the weight-average particle size (D4) was calculated. Here, "Average size" on the Analysis/Volume Statistic Value (Arithmetic Mean) screen (in Japanese) in a state where graph/volume % is set in the software program represents the weight average particle size (D4).

Procedure for Checking for the Structure Represented By Formula (RaT3):

It is checked by nuclear magnetic resonance (NMR) whether the organosilicon polymer has the structure represented by formula (RaT3).

Samples for NMR measurement are prepared as described below. Preparation of measurement sample:

In an extraction thimble (No. 86R, manufactured by Toyo Roshi) is placed 10.0 g of toner particles, and the toner particles are subjected to extraction for 20 hours with 200 mL of tetrahydrofuran as the solvent in a Soxhlet extractor. The substance remaining in the extraction thimble is dried at 40° C. in vacuum for several hours to yield an NMR measurement sample.

Ra bound to the silicon atom of the structure represented by formula (RaT3) is checked by $^{13}$C-NMR (solid). $^{13}$C-NMR (solid) measurement is performed under the following conditions:

Apparatus: JNM-ECX 500II manufactured by JEOL RESONANCE
Sample tube: 3.2 mm in diameter
Sample: 150 mg of tetrahydrofuran-insoluble fraction of NMR measurement toner particles
Measurement temperature: room temperature (25° C.)
Pulse mode: CP/MAS
Measurement nuclear frequency: 123.25 MHz($^{13}$C)
Reference material: adamantane (extremal standard: 29.5 ppm)
Sample rotation: 20 kHz
Contact time: 2 ms
Delay time: 2 s
Number of integrations: 1024

For the structure of formula (RaT3) in which Ra is a hydrocarbon group having a carbon number of 1 to 6, the presence of Ra is determined according to the presence or absence of the signal derived from the alkyl group bound to the silicon atom, such as methyl (Si—$CH_3$), ethyl (Si—$C_2H_5$), propyl (Si—$C_3H_7$), butyl (Si—$C_4H_9$), pentyl (Si—$C_5H_{11}$), hexyl (Si—$C_6H_{13}$), or phenyl (Si—$C_6H_5$—).

For the structure of formula (RaT3) in which Ra is represented by formula (i), the presence of the structure represented by formula (i) is determined according to the presence or absence of the signal derived from the methine group bound to the silicon atom (>CH—Si).

For the structure in which Ra is represented by formula (ii), the presence of the structure represented by formula (ii) is determined according to the presence or absence of the signal derived from the methylene or arylene group bound to the silicon atom, such as methylene (Si—$CH_2$—), ethylene (Si—$C_2H_4$—), or phenylene (Si—$C_6H_4$—).

The presence of siloxane bonds in formula (RaT3) is checked by $^{29}$Si-NMR (solid). $^{29}$Si-NMR (solid) measurement is performed under the following conditions:

Apparatus: JNM-ECX 500II manufactured by JEOL RESONANCE
Sample tube: 3.2 mm in diameter
Sample: 150 mg of tetrahydrofuran-insoluble fraction of NMR measurement toner particles
Measurement temperature: room temperature (25° C.)
Pulse mode: CP/MAS
Measurement nuclear frequency: 97.38 MHz($^{29}$Si)
Reference material: DSS (external standard: 1.534 ppm)
Sample rotation: 10 kHz
Contact time: 10 ms
Delay time: 2 s
Number of integrations: 2000 to 8000

After the measurement, the silane components, different in substituent and linking member, in the tetrahydrofuran-insoluble fraction of the toner particles are subjected to peak separation by curve fitting into the following structures represented by formulas (5) to (8), referred to as structure X1, structure X2, structure X3, and structure X4, respectively, and the areas of these peaks are calculated.

Structure X1 represented by formula (5): $(Ri)(Rj)(Rk)SiO_{1/2}$
Structure X2 represented by formula (6): $(Rg)(Rh)Si(O_{1/2})_2$
Structure X3 represented by formula (7): $RmSi(O_{1/2})_3$
Structure X4 represented by formula (8): $Si(O_{1/2})_4$ (5)

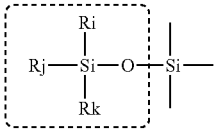

(6)

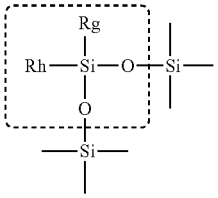

(7)

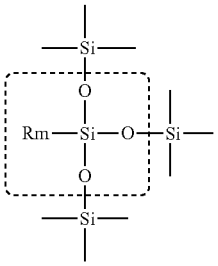

(8)

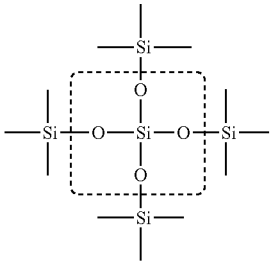

In formulas (5) to (8), Ri, Rj, Rk, Rg, Rh, and Rm each represent an organic group such as a hydrocarbon group having a carbon number of 1 to 6, a halogen atom, a hydroxy group, an acetoxy group, or an alkoxy group.

In formulas (5) to (8), the portions surrounded by each rectangular dashed line are structures X1 to X4, respectively. The oxygen atoms in formulas (5) to (8), which are each bound to two silicon atoms, are counted as ½ per silicon atom (represented as $O_{1/2}$).

In the chart obtained by the $^{29}$Si-NMR of the tetrahydrofuran-insoluble fraction of the toner, the peak area imputed to the structure of formula (RaT3) may account for 20% to 100% of the total peak area of the organosilicon polymer. In an embodiment, it may account for 40% to 80%.

If the structure represented by formula (RaT3) is examined in more detail, the identification thereof may be performed by $^{1}$H-NMR in addition to the above-described $^{13}$C-NMR and $^{29}$Si-NMR.

EXAMPLES

The subject matter of the present disclosure will be further described in detail with reference to the following Production Examples, Examples, and Comparative Examples. In the following description, "part(s)" is on a mass basis unless otherwise specified.

Production of Intermediate Transfer Belt

Belt 8-1

Base Layer Formation:

A base layer 8*b* of belt 8-1 was formed as described below.

A poly(ethylene naphthalate) resin (PEN) in which carbon black is dispersed as an electric resistance adjusting agent was formed into a bolt form by stretch blow molding, and the bolt form was cut into an endless belt with an ultrasonic cutter. The resulting 70 μm-thick PEN resin belt was used as the base layer 8*b* of belt 8-1.

Preparation of Surface Layer Forming Coating Liquid (UV-Curable Resin Composition):

The coating liquid used for forming the surface layer 8*a* of belt 8-1 was prepared as described below.

In a container shielded from UV light, the following ingredients were mixed together:

50 parts of PTFE surface layer particles 83, Lubron L-2 (produced by Daikin Industries), having a primary particle size of 200 nm;

100 parts of an acrylic copolymer having an unsaturated double bond, OPSTAR Z7501 (produced by JSR), as the curable material 81;

50 parts of methyl isobutyl ketone; and 119 parts of isopropanol sol containing zinc antimonate particles, CELNAX CX-Z210IP (produced by Nissan Chemical Industries, solids content: 21% by mass), as the electrically conductive material 82.

The mixture was agitated for dispersion in a high-pressure emulsifying disperser to yield a UV-curable resin composition. The resulting composition was used as the coating liquid for forming the surface layer 8*a* of belt 8-1.

Production of Intermediate Transfer Belt Provided with Surface Layer:

The surface layer 8*a* was formed on the base layer 8*b* as described below to yield Belt 8-1.

The UV-curable resin composition was applied onto the base layer 8*b* of belt 8-1 formed as described above by dip coating at 25° C. and 60% RH.

The UV-curable resin composition was cured 10 seconds after the completion of dip coating with an UV irradiation device UE06/81-3 (manufactured by iGrafx, integral of light: 1000 mJ/cm$^2$) placed under the same conditions as the conditions for the dip coating. Thus, a 3 μm-thick surface layer 8*a* containing mainly a cured acrylic resin was formed.

Thus, endless belt 8-1 having a surface layer 8*a* was completed. The volume resistivity of belt 8-1 was $1.0\times10^{10}$ Ω·cm.

The proportion of the PTFE particles in the surface layer 8*a* of belt 8-1 (surface layer particles 83) was 50 parts relative to 100 parts of the acrylic resin. The proportion of the zinc antimonate particles (electrically conductive material 82) was 25 parts relative to 100 parts of the acrylic resin.

Belt 8-2

Belt 8-2 was produced in the same manner as belt 8-1 except that PTFE particles (surface layer particles 83) were not added to the surface layer 8*a*.

Comparative Belt 8-1

Comparative Belt 8-1 was produced in the same manner as belt 8-1 except the surface layer 8*a* was not formed. Hence, comparative belt 8-1 was a single-layer belt.

Comparative Belt 8-2

Comparative belt 8-2 was a single-layer belt using a polyimide (PI) base layer 8*b*, having a thickness of 70 μm and a volume resistivity of $1.0\times10^{10}$ Ω·cm.

TABLE 1

| Intermediate transfer belt | Base layer | Surface layer | Surface layer particles | Charge (nC/g, absolute value) |
|---|---|---|---|---|
| Belt 8-1 | PEN | Acrylic coating | PTFE | 1.42 |
| Belt 8-2 | PEN | Acrylic coating | None | 1.15 |
| Comparative belt 8-1 | PEN | None | None | 4.38 |
| Comparative belt 8-2 | PI | None | None | 6.2 |

Production of Toner 1

Preparation of aqueous medium 1:

Into 1000.0 parts of ion-exchanged water in a reaction vessel was added 14.0 parts of sodium phosphate (12-hydrate, produced by Rasa Industries), followed by warming at 65° C. for 1.0 hour with nitrogen purging. Into this liquid being stirred at 12000 rpm with T. K. Homo Mixer (manufactured by Primix) was added the entirety of a calcium chloride aqueous solution prepared by dissolving 9.2 parts of calcium chloride (dihydrate) in 10.0 parts of ion-exchanged water to yield an aqueous medium containing a dispersion stabilizer. The aqueous medium was adjusted to a pH of 6.0 by adding 10 mass % hydrochloric acid to yield aqueous medium 1.

Preparation of Polymerizable Monomer Composition:

styrene: 60.0 parts; and

C. I. Pigment Blue 15:3: 6.5 parts

These materials were added into an attritor (manufactured by Nippon Coke & Engineering) and then dispersed in each other at 220 rpm for 5.0 hours with zirconia grains of 1.7 mm in diameter to yield a pigment dispersion liquid. Into the resulting pigment dispersion liquid were added the following materials:

styrene: 14.0 parts;

n-butyl acrylate: 26.0 parts;

crosslinking agent (divinylbenzene): 0.2 part;

saturated polyester resin (polycondensate of propylene oxide-modified bisphenol A (2-mole adduct) and terephthalic acid, mole ratio: 10:12, glass transition temperature Tg: 68° C., weight average molecular weight Mw: 10000, molecular weight distribution Mw/Mn: 5.12): 6.0 parts;

Fischer-Tropsch wax (melting point: 78° C.): 10.0 parts; and charge control agent (aluminum 3,5-di-tert-butylsalicylate): 0.5 part While being warmed at 65° C., the ingredients were dissolved or dispersed in each other with T. K. Homo Mixer at 500 rpm to yield a polymerizable monomer composition.

Preparation of Organosilicon Compound Solution:

Ion-exchanged water (60.0 parts) was weighed out into a reaction vessel equipped with a stirring device and a thermometer, and 10 mass % hydrochloric acid was added to the water to adjust the pH to 1.5. The water was heated to 60° C. with stirring. Then, 40.0 parts of methyltriethoxysilane was added, followed by stirring for 2 minutes to yield organosilicon compound solution 1.

Formation of Particles:

The polymerizable monomer composition was added into aqueous medium 1 being stirred with a stirring device at 12000 rpm at 70° C., and then 9.0 parts of t-butyl peroxypivalate was added as a polymerization initiator. The mixture was stirred with the stirring device kept at 12000 rpm over 10 minutes to form particles of the polymerizable monomer composition.

Polymerization:

The high-speed stirring device is replaced with a propeller stirring blade. The contents in the vessel were kept at 70° C. with stirring at 150 rpm for polymerization for 5.0 hours and further heated to 95° C. for 2.0 hours for polymerization to yield a slurry of toner particles. Then, the slurry was cooled to 60° C. The pH of the slurry at this time was 5.0.

Subsequently, 20.0 parts (shown in Table 2) of organosilicon compound solution 1 was added into the slurry being stirred at 60° C. After being allowed to stand in this state for 30 minutes, the slurry was adjusted to a pH of 9.0 with a sodium hydroxide aqueous solution, followed by being allowed to stand for further 300 minutes. Thus, an organosilicon polymer was formed at the surface of the base material to yield toner particles.

Washing and Drying:

After the polymerization, the slurry of the toner particles was cooled and then adjusted to a pH of 1.5 or less with a hydrochloric acid solution. After being allowed to stand for 1 hour, the slurry was subjected to solid-liquid separation with a pressure filter to yield toner cake. The toner cake was slurried again into a dispersion liquid with ion-exchanged water, and the dispersion liquid was subjected to solid-liquid separation with the same filter. The slurrying and solid-liquid separation were repeated until the electric conductivity of the filtrate came to 5.0 μS/cm or less.

The finally obtained toner cake was dried with an air dryer FLASH JET DRYER (manufactured by Seishin) and then subjected to sizing to remove fine and coarse powder with a multi-class classifier using the Coanda effect to yield toner particles 1.

The drying of the toner cake was performed under the conditions: blowing temperature of 90° C., dryer outlet temperature of 40° C. while the feeding rate of the toner cake was controlled so that the outlet temperature could not vary from 40° C. depending on the water content of the toner cake.

In the Examples of the present disclosure, the resulting toner particles 1 were use as toner 1 without adding any external additive. It was confirmed by the above-described procedure that Toner 1 includes toner particles including a surface layer containing an organosilicon polymer. The physical properties of the toner are shown in Table 3.

Production of Toners 2 to 19 and Comparative Toners 1, 2, 5, and 6:

Toners 2 to 19 and comparative toners 1, 2, 5, and 6 were produced in the same manner as toner 1, except for the material and the conditions shown in Table 2. The physical properties of the resulting toners are shown in Table 3.

Production of Comparative Toner 3:

In contrast to the production of toner 1, 12.0 parts of methyltriethoxysilane in a state of monomer was added into the pigment dispersion liquid for preparing the polymerizable monomer composition. Also, the organosilicon compound solution was not prepared. In the polymerization step, the hydrolyzed solution was not added, and the reaction system was subjected to only pH adjustment and allowed to stand. Other operation was performed in the same manner as the production of toner 1, and thus comparative toner 3 was produced. The physical properties of the resulting toner are shown in Table 3.

Production of Comparative Toner 4

Comparative toner 4 was produced in the same manner as comparative toner 3 except that the amount of methyltriethoxysilane was changed to 7.4 parts. The physical properties of the resulting toner are shown in Table 3.

Production of Comparative Toner 7

In contrast to the production of toner 1, the organosilicon compound solution was not prepared. After obtaining the slurry of toner particles in the polymerization step, 8.0 parts of methyltriethoxysilane in a state of monomer was added into the slurry cooled to 60° C. and being kept stirred. After being allowed to stand in this state for 30 minutes, the slurry was adjusted to a pH of 9.0 with a sodium hydroxide aqueous solution, followed by being allowed to stand for further 300 minutes. Thus, an organosilicon polymer was formed over the surfaces of the toner particles. Other operation was performed in the same manner as the production of toner 1, and thus comparative toner 7 was produced. The physical properties of the resulting toner are shown in Table 3.

Production of Comparative Toner 8

Comparative toner 8 was produced in the same manner as comparative toner 7 except that the amount of methyltriethoxysilane was changed to 9.4 parts. The physical properties of the resulting toner are shown in Table 3.

Production of Comparative Toner 9

In contrast to the production of toner 1, the organosilicon compound solution was not prepared. After obtaining the slurry of toner particles in the polymerization step, 250 parts of methyltriethoxysilane in a state of monomer was added to the slurry cooled to 25° C. and being kept stirred. Furthermore, 4000.0 parts of ion-exchanged water was added. After allowing the resulting solution to stand under the same conditions for 30 minutes, the solution was gradually dropped into 10000.0 parts of pH 9.0 sodium hydroxide solution, followed by being allowed to stand at 25° C. for 48 hours to yield toner particles including a surface layer containing an organosilicon polymer. Other operation was performed in the same manner as the production of toner 1, and thus comparative toner 9 was produced. The physical properties of the resulting toner are shown in Table 3.

Evaluation of Image Output

Sticking During Fixing at Low Temperature:

The fuser unit of Canon laser beam printer LBP 9600C was modified so that the fixing temperature was able to be adjusted. The fixing temperature was varied by using this modified LBP 9600C from 140° C. in increments of 5° C. under the conditions of a process speed of 300 mm/s at normal temperature and normal humidity (25° C./50% RH).

A solid pattern was formed on an image receiving paper sheet with the toner to be subjected to evaluation at a toner rate of 0.40 mg/cm$^2$ and fixed to the image receiving paper sheet by oil-less heating and pressurization. At this time, the state of feeding the paper sheet was visually checked for sticking. If the sheet was fed without sticking, the temperature of the fuser was measured, and the toner was graded in terms of sticking of thin paper during fixing at low temperature according to the following criteria. A paper sheet GF-600 (basis weight: 60 g/m$^2$) available from Canon Marketing Japan was used as the image receiving paper sheet.

A: less than 150° C.
B: from 150° C. to less than 155° C.
C: from 155° C. to less than 160° C.
D: from 160° C. to less than 170° C.
E: 170° C. or more In the present disclosure, Grade C or more (that is, A to C) were considered to be good.

Nonuniform Transfer:

The cyan toner process cartridge (toner cartridge) PC of the image forming apparatus body 100 according to an embodiment of the present, shown in FIG. 3 was charged with 200 g of toner to be evaluated. Then, the process cartridge was allowed to stand in a high-temperature, high-humidity environment (32.5° C. and 85% RH) for 24 hours.

After 24-hour standing, the process cartridge was mounted in the image forming apparatus body 100 and the intermediate transfer belt to be evaluated was mounted on the intermediate transfer belt 8. In this state, a pattern with a coverage of 1.0% was printed on 15000 A4 sheets in the lateral direction of the A4 sheet. After output of 15000 sheets, a solid pattern with a toner rate of 0.40 mg/cm$^2$ was output on a paper sheet CS-680 (basis weight: 68 g/m$^2$) available from Canon Marketing Japan. This pattern was visually checked for nonuniform transfer according to the following criteria. In the present disclosure, nonuniform portions in the pattern were determined to be the portion where nonuniform transfer occurred.

S: No nonuniform transfer was not seen even when the pattern was observed under normal light or held to strong light.
A: Nonuniform transfer was hardly seen even when the pattern was observed under normal light or held to strong light.
B: Although no nonuniform transfer was seen under normal light, some nonuniform transfer was seen when the pattern was held to strong light.
C: Nonuniform transfer was seen at one or two portions under normal light, but no white spot was seen.
D: Nonuniform transfer was seen at three or four portions under normal light, but no white spot was seen.
E: Nonuniform transfer was seen at five or more portions, or one or more white spots were seen.

In the present disclosure, C and higher grades (that is, S to C) were considered to be good, and A and the higher grade (that is, A and S) were considered to be excellent.

Low-Temperature Fixability:

LBP 9600C modified so that the fixing temperature was able to be adjusted as in the evaluation of sticking during fixing at low temperature was used. The fixing temperature was varied from 140° C. in increments of 5° C. under the conditions of a process speed of 300 mm/s at normal temperature and normal humidity (25° C./50% RH). A solid pattern was formed on an image receiving paper sheet with the toner to be evaluated at a toner rate of 0.40 mg/cm$^2$ and fixed to the image receiving paper sheet by oil-less heating and pressurization. The fixed pattern was rubbed 10 times with Kimwipe Waste Paper Sheet S-200 (manufactured by Crecia Corporation) with a load of 75 g/cm$^2$. The temperature at which the decrease in image density was less than 5% was defined as fixing temperature, and the samples were graded according to the following criteria.

A paper sheet business 4200 (basis weight: 105 g/m$^2$) manufactured by Xerox was used as the image receiving paper sheet. The image density was measured relative to a printed image at a white portion having an original sheet density of 0.00 with a color reflection densitometer X-RITE 404A (manufactured by X-Rite), and the decrease in image density after rubbing was calculated.

A: less than 150° C.
B: from 150° C. to less than 160° C.
C: from 160° C. to less than 170° C.
D: 170° C. or more In the present disclosure, Grade C or more (that is, A to C) were considered to be good.

Examples 1 to 17, Comparative Examples 1 to 11

The intermediate transfer belts shown in Table 1 and the toners shown in Tables 2 and 3 were examined in terms of sticking during fixing at low temperature, nonuniform transfer, and low-temperature fixability. The results are shown in Table 4.

Table 4 suggests that Examples 1 to 17 do not easily allow thin paper to stick to the fuser during fixing at low temperature and do not cause nonuniform transfer even after repetitive use in a high-temperature, high-humidity environment. Although Examples 1 to 17 shown in Table 4 used either belt 8-1 or 8-2 for convenience sake, the toners used in Examples 1 to 17 produced excellent results to the same extent even when used in combination with either of the belts.

TABLE 2

| | | Conditions for preparation of organosilicon compound solution | | | Addition of organosilicon |
|---|---|---|---|---|---|
| | Organosilicon compound | pH | Temperature (° C.) | Time (min.) | compound solution (parts by mass) |
| Toner 1 | Methyltriethoxysilane | 1.5 | 60 | 2 | 20.0 |
| Toner 2 | Methyltriethoxysilane | 1.5 | 60 | 2 | 21.5 |
| Toner 3 | Methyltriethoxysilane | 1.5 | 60 | 2 | 18.0 |
| Toner 4 | Methyltriethoxysilane | 1.5 | 80 | 2 | 20.0 |
| Toner 5 | Methyltriethoxysilane | 1.5 | 60 | 2 | 23.5 |
| Toner 6 | Methyltriethoxysilane | 1.5 | 60 | 2 | 16.5 |
| Toner 7 | Methyltriethoxysilane | 1.5 | 80 | 5 | 23.5 |
| Toner 8 | Methyltriethoxysilane | 1.5 | 40 | 2 | 20.0 |
| Toner 9 | Methyltriethoxysilane | 1.5 | 40 | 2 | 21.5 |
| Toner 10 | Methyltriethoxysilane | 1.5 | 80 | 5 | 18.5 |
| Toner 11 | Methyltriethoxysilane | 1.5 | 60 | 2 | 13.5 |
| Toner 12 | Methyltriethoxysilane | 1.5 | 60 | 2 | 30.0 |
| Toner 13 | Vinyltrimethoxysilane | 1.5 | 60 | 2 | 13.5 |
| Toner 14 | n-Propyltriethoxysilane | 1.5 | 60 | 2 | 13.5 |
| Toner 15 | Allyltrietoxysilane | 1.5 | 60 | 2 | 13.5 |
| Toner 16 | Hexyltriethoxysilane | 1.5 | 60 | 2 | 13.5 |
| Toner 17 | Phenyltriethoxysilane | 1.5 | 60 | 2 | 13.5 |
| Toner 18 | Methyltriethoxysilane | 1.5 | 80 | 2 | 30.0 |
| Toner 19 | Methyltriethoxysilane | 1.5 | 80 | 5 | 30.0 |
| Comparative toner 1 | Methyltriethoxysilane | 1.5 | 60 | 2 | 1.5 |
| Comparative toner 2 | Methyltriethoxysilane | 1.5 | 60 | 2 | 57.5 |
| Comparative toner 3 | Methyltriethoxysilane | See the description | | | |
| Comparative toner 4 | Methyltriethoxysilane | | | | |
| Comparative toner 5 | Methyltriethoxysilane | 1.5 | 60 | 2 | 37.0 |
| Comparative toner 6 | Hexyltriethoxysilane | 1.5 | 60 | 2 | 10.0 |
| Comparative toner 7 | Methyltriethoxysilane | See the description | | | |
| Comparative toner 8 | Methyltriethoxysilane | | | | |
| Comparative toner 9 | Methyltriethoxysilane | | | | |

TABLE 3

| | Brightness | | Pixel value relative to sum of pixel values (%) | | | | Number average value in particle A1 analysis | | Presence of | Weight average |
|---|---|---|---|---|---|---|---|---|---|---|
| | P1 | P2 | P1 | P2 | (A1/AV) | (A2/AV) | Particle area ($nm^2$) | Feret diameter (nm) | organosilicon polymer network structure | particle size (μm) |
| Toner 1 | 38 | 165 | 1.08 | 0.91 | 2.25 | 3.01 | $5.43 \times 10^3$ | 95 | Yes | 6.4 |
| Toner 2 | 37 | 162 | 0.82 | 1.10 | 2.01 | 3.25 | $4.92 \times 10^3$ | 92 | Yes | 6.5 |
| Toner 3 | 39 | 166 | 1.09 | 0.88 | 2.47 | 2.88 | $6.41 \times 10^3$ | 102 | Yes | 6.4 |
| Toner 4 | 42 | 164 | 1.00 | 0.86 | 1.66 | 1.77 | $4.01 \times 10^3$ | 79 | Yes | 6.4 |
| Toner 5 | 35 | 159 | 0.67 | 1.10 | 1.75 | 3.44 | $3.88 \times 10^3$ | 71 | Yes | 6.5 |
| Toner 6 | 42 | 167 | 1.19 | 0.58 | 2.77 | 2.63 | $7.62 \times 10^3$ | 124 | Yes | 6.5 |
| Toner 7 | 44 | 166 | 0.97 | 0.84 | 1.56 | 1.68 | $3.40 \times 10^3$ | 66 | Yes | 6.6 |
| Toner 8 | 67 | 143 | 1.13 | 0.86 | 1.58 | 1.66 | $3.76 \times 10^3$ | 68 | Yes | 6.4 |
| Toner 9 | 62 | 137 | 1.01 | 0.97 | 1.53 | 1.67 | $2.89 \times 10^3$ | 64 | Yes | 6.5 |
| Toner 10 | 46 | 165 | 1.02 | 0.82 | 1.67 | 1.55 | $4.33 \times 10^3$ | 69 | Yes | 6.5 |
| Toner 11 | 40 | 166 | 1.28 | 0.52 | 3.00 | 2.36 | $9.14 \times 10^3$ | 146 | Yes | 6.4 |
| Toner 12 | 32 | 157 | 0.54 | 1.21 | 1.67 | 3.77 | $2.42 \times 10^3$ | 66 | Yes | 6.4 |
| Toner 13 | 41 | 162 | 1.31 | 0.53 | 3.04 | 2.42 | $1.05 \times 10^4$ | 145 | Yes | 6.5 |
| Toner 14 | 38 | 166 | 1.27 | 0.54 | 3.17 | 2.33 | $1.20 \times 10^4$ | 155 | Yes | 6.6 |
| Toner 15 | 40 | 166 | 1.29 | 0.53 | 3.11 | 2.44 | $1.25 \times 10^4$ | 157 | Yes | 6.4 |

TABLE 3-continued

| | Brightness | | Pixel value relative to sum of pixel values (%) | | | | Number average value in particle A1 analysis | | Presence of | Weight average |
|---|---|---|---|---|---|---|---|---|---|---|
| | P1 | P2 | P1 | P2 | (A1/AV) | (A2/AV) | Particle area ($nm^2$) | Feret diameter (nm) | organosilicon polymer network structure | particle size (μm) |
| Toner 16 | 40 | 165 | 1.25 | 0.51 | 3.10 | 2.29 | $1.49 \times 10^4$ | 206 | Yes | 6.4 |
| Toner 17 | 41 | 167 | 1.17 | 0.57 | 2.84 | 2.65 | $7.88 \times 10^3$ | 137 | Yes | 6.6 |
| Toner 18 | 35 | 158 | 0.55 | 1.04 | 1.59 | 3.53 | $1.96 \times 10^3$ | 62 | Yes | 6.6 |
| Toner 19 | 38 | 157 | 0.54 | 0.98 | 1.52 | 3.21 | $1.77 \times 10^3$ | 56 | Yes | 6.4 |
| Comparative toner 1 | 29 | — | 4.41 | — | — | — | — | — | No | 6.5 |
| Comparative toner 2 | — | 172 | — | 3.98 | — | — | — | — | No | 6.5 |
| Comparative toner 3 | 41 | 158 | 0.55 | 0.99 | 1.46 | 2.87 | $1.56 \times 10^3$ | 50 | Yes | 6.6 |
| Comparative toner 4 | 48 | 164 | 1.03 | 0.80 | 1.55 | 1.45 | $3.42 \times 10^3$ | 64 | Yes | 6.5 |
| Comparative toner 5 | 30 | 153 | 0.44 | 1.28 | 1.53 | 3.98 | $1.91 \times 10^3$ | 57 | Yes | 6.4 |
| Comparative toner 6 | 38 | 162 | 1.37 | 0.45 | 3.32 | 2.03 | $1.64 \times 10^3$ | 212 | Yes | 6.6 |
| Comparative toner 7 | 72 | 134 | 1.20 | 0.82 | 1.55 | 1.64 | $2.44 \times 10^3$ | 65 | Yes | 6.4 |
| Comparative toner 8 | 67 | 128 | 1.04 | 0.97 | 1.52 | 1.68 | $2.11 \times 10^3$ | 62 | Yes | 6.4 |
| Comparative toner 9 | 68 | 128 | 1.18 | 0.83 | 1.16 | 1.34 | $1.74 \times 10^3$ | 55 | Yes | 6.5 |

TABLE 4

| | Toner | Intermediate transfer belt | Sticking at low-temperature | Nonuniform transfer | Low temperature fixing |
|---|---|---|---|---|---|
| Example 1 | Toner 1 | Belt 8-1 | A | S | A |
| Example 2 | Toner 2 | Belt 8-1 | A | S | A |
| Example 3 | Toner 3 | Belt 8-1 | A | S | A |
| Example 4 | Toner 4 | Belt 8-1 | B | S | A |
| Example 5 | Toner 5 | Belt 8-2 | B | S | A |
| Example 6 | Toner 6 | Belt 8-2 | A | A | A |
| Example 7 | Toner 7 | Belt 8-2 | B | A | A |
| Example 8 | Toner 10 | Belt 8-2 | B | A | A |
| Example 9 | Toner 11 | Belt 8-2 | A | A | A |
| Example 10 | Toner 12 | Belt 8-1 | C | S | A |
| Example 11 | Toner 13 | Belt 8-1 | A | A | B |
| Example 12 | Toner 14 | Belt 8-1 | A | A | B |
| Example 13 | Toner 15 | Belt 8-1 | A | A | B |
| Example 14 | Toner 16 | Belt 8-1 | A | A | C |
| Example 15 | Toner 17 | Belt 8-1 | A | A | A |
| Example 16 | Toner 18 | Belt 8-1 | C | S | B |
| Example 17 | Toner 19 | Belt 8-2 | C | S | C |
| Comparative Example 1 | Comparative toner 1 | Belt 8-1 | A | D | C |
| Comparative Example 2 | Comparative toner 2 | Comparative belt 8-1 | E | A | C |
| Comparative Example 3 | Comparative toner 3 | Belt 8-2 | D | S | C |
| Comparative Example 4 | Comparative toner 4 | Comparative belt 8-2 | B | D | A |
| Comparative Example 5 | Comparative toner 5 | Comparative belt 8-1 | D | A | C |
| Comparative Example 6 | Comparative toner 6 | Comparative belt 8-1 | A | D | C |
| Comparative Example 7 | Comparative toner 7 | Comparative belt 8-2 | D | C | A |
| Comparative Example 8 | Comparative toner 8 | Comparative belt 8-2 | C | D | A |
| Comparative Example 9 | Comparative toner 9 | Belt 8-1 | D | D | C |

"Sticking at low temperature" in Table 4 refers to sticking during fixing at low temperature.

The present disclosure provides an image forming apparatus and an image forming method that do not easily cause thin paper to stick to the fuser during fixing at low temperature and does not easily cause insufficient transfer (nonuniform transfer) even when repeatedly used in a high-temperature, high-humidity environment.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-166006, filed Aug. 30, 2017, which is hereby incorporated by reference herein in its entirety.

What is claimed is:

1. An image forming apparatus, comprising:

an image bearing member;

a developing device including a toner bearing member and a toner container containing a toner, the developing device being configured to form a toner image on the image bearing member with the toner on the toner bearing member; and an intermediate transfer member to which the toner image is primarily transferred from the image bearing member and from which the toner image is secondarily transferred to a transfer medium, wherein the intermediate transfer member has a charge of 3.0 nC/g or less in terms of absolute value at the surface thereof when charged by a slanted charging method, wherein the toner includes toner particles containing a binder resin and a releasing agent, and the toner particles include a surface layer containing an organosilicon polymer, wherein a brightness histogram of the number of pixels with reference to 256 levels of brightness on the horizontal axis thereof, obtained from a backscattered electron image of a square area 1.5 μm on a side of the surface of the toner particles taken by observing the surface of the toner particles by scanning electron microscopy has:

two local maximums P1 and P2, P1 being in a brightness range of 20 to 70, P2 being derived from the organosilicon polymer and being in a brightness range of 130 to 230; and a local minimum V between P1 and P2, wherein the number of pixels of P1 and the number of pixels of P2 are each 0.50% or more relative to the total number of pixels of the backscattered electron image, and wherein with reference to a brightness V1 of the local minimum V, a total number A1 of pixels with a brightness of 0 to (V1−30), a total number AV of pixels with a brightness of (V1−29) to (V1+29), and a total number A2 of pixels with a brightness of (V1+30) to 255 satisfy the following relationships (1) and (2):

$$(A1/AV) \geq 1.50 \quad (1); \text{ and}$$

$$(A2/AV) \geq 1.50 \quad (2).$$

2. The image forming apparatus according to claim 1, wherein the organosilicon polymer at the surface of the toner particles form a network structure having a mesh defined by particles defined by pixels with a brightness of 0 to (V1−30), and in the backscattered electron image, the particles defined by the pixels with a brightness of 0 to (V1−30) have a number average area of $2.00\times10^3$ nm$^2$ to $1.00\times10^4$ nm$^2$ and a number average Feret diameter of 60 nm to 200 nm.

3. The image forming apparatus according to claim 1, wherein the organosilicon polymer has a structure represented by the following formula (RaT3):

(RaT3)

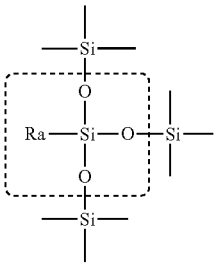

(i)

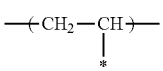

(ii)

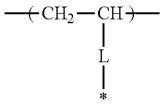

wherein Ra in formula (RaT3) represents one of a hydrocarbon group having a carbon number of 1 to 6 and a unit represented by formula (i) or (ii), * in formulas (i) and (ii) representing a bonding site to the silicon atom in the structure of formula (RaT3), and L in formula (ii) representing an alkylene group or an arylene group.

4. The image forming apparatus according to claim 1, wherein the intermediate transfer member includes a surface layer containing an acrylic resin as a major binder.

5. An image forming method, comprising:

forming a toner image on an image bearing member by development with a toner on a toner bearing member;

primarily transferring the toner image to an intermediate transfer member; and secondary transferring the toner image on the intermediate transfer member to a transfer medium, wherein the intermediate transfer member has a charge of 3.0 nC/g or less in terms of absolute value at the surface thereof when charged by a slanted charging method, wherein the toner includes toner particles containing a binder resin and a releasing agent, and toner particles include a surface layer containing an organosilicon polymer, wherein a brightness histogram of the number of pixels with reference to 256 levels of brightness on the horizontal axis thereof, obtained from a backscattered electron image of a square area 1.5 μm on a side of the surface of the toner particles taken by observing the surface of the toner particles by scanning electron microscopy has:

two local maximums P1 and P2, P1 being in a brightness range of 20 to 70, P2 being derived from the organosilicon polymer and being in a brightness range of 130 to 230; and a local minimum V between P1 and P2, wherein the number of pixels of P1 and the number of pixels of P2 are each 0.50% or more relative to the total number of pixels of the backscattered electron image, and wherein with reference to a brightness V1 of the local minimum V, a total number A1 of pixels with a brightness of 0 to (V1−30), a total number AV of pixels with a brightness of (V1−29) to (V1+29), and a total number A2 of pixels with a brightness of (V1+30) to 255 satisfy the following relationships (1) and (2):

$$(A1/AV) \geq 1.50 \quad (1); \text{ and}$$

$$(A2/AV) \geq 1.50 \quad (2).$$

6. The image forming method according to claim 5, wherein the organosilicon polymer at the surface of the toner particles forms a network structure having a mesh defined by particles defined by pixels with a brightness of 0 to (V1−30), and in the backscattered electron image, the particles defined by the pixels with a brightness of 0 to (V1−30) have a number average area of $2.00\times10^3$ nm$^2$ to $1.00\times10^4$ nm$^2$ and a number average Feret diameter of 60 nm to 200 nm.

7. The image forming method according to claim 5, wherein the organosilicon polymer has a structure represented by the following formula (RaT3):

(RaT3)

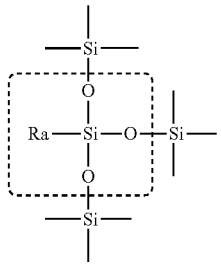

(i)

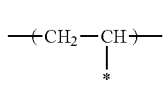

-continued (ii)

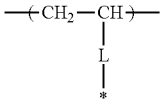

wherein Ra in formula (RaT3) represents one of a hydrocarbon group having a carbon number of 1 to 6 and a unit represented by formula (i) or (ii), * in formulas (i) and (ii) representing a bonding site to the silicon atom in the structure of formula (RaT3), and L in formula (ii) representing an alkylene group or an arylene group.

8. The image forming method according to claim 5, wherein the intermediate transfer member includes a surface layer containing an acrylic resin as a major binder.

* * * * *